US010899134B2

(12) United States Patent
Kida et al.

(10) Patent No.: US 10,899,134 B2
(45) Date of Patent: Jan. 26, 2021

(54) PRINTING APPARATUS AND METHOD FOR CONTROLLING THE SAME

(71) Applicant: CANON KABUSHIKI KAISHA, Tokyo (JP)

(72) Inventors: Akira Kida, Yokohama (JP); Tetsuji Kurata, Yokohama (JP); Atsushi Kohnotoh, Kawasaki (JP); Toshihide Wada, Yokohama (JP); Noboru Shimoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/299,289

(22) Filed: Mar. 12, 2019

(65) Prior Publication Data

US 2019/0283434 A1 Sep. 19, 2019

(30) Foreign Application Priority Data

Mar. 13, 2018 (JP) ..... 2018-045674

(51) Int. Cl.
*B41J 2/175* (2006.01)
*B41J 29/13* (2006.01)

(52) U.S. Cl.
CPC ..... *B41J 2/1752* (2013.01)

(58) Field of Classification Search
CPC ..... B41J 29/13
See application file for complete search history.

(56) References Cited

U.S. PATENT DOCUMENTS 8,480,212 B2 7/2013 Tsukuda et al.
2005/0062793 A1* 3/2005 Takagi ..... B41J 2/165 347/29
2012/0050421 A1* 3/2012 Hamasaki ..... B41J 2/17509 347/85
2013/0250013 A1* 9/2013 Koichi ..... B41J 2/1752 347/86
2016/0271955 A1* 9/2016 Ono ..... B41J 2/16535
2017/0326893 A1* 11/2017 Yamamoto ..... B41J 11/70
2019/0243300 A1* 8/2019 Matsuo ..... B41J 29/02
2019/0375212 A1* 12/2019 Ueno ..... B41J 2/185

FOREIGN PATENT DOCUMENTS

JP 2007021856 A * 2/2007
JP 5566067 B2 8/2014

OTHER PUBLICATIONS

Machine generated English translation of JP2007021856 to Sato, "Liquid Jetting Apparatus"; translation retrieved via https://worldwide.espacenet.com on Feb. 5, 2020; 18pp.*

* cited by examiner

*Primary Examiner* — Shelby L Fidler
(74) *Attorney, Agent, or Firm* — Venable LLP

(57) ABSTRACT

The printing apparatus of the present invention includes: an openable cover that covers a head holder that mounts a print head detachably and an ink tank, detachable from the apparatus, configured to store ink to be supplied to the print head; a lock unit capable of switching between a lock state where the cover is fixed to a closed position and an unlocked state where the cover is not fixed to the closed position; and a control unit configured to control, in a case of receiving instructions to detach the ink tank, the lock unit to switch to the unlocked state after controlling a holder moving unit to move the head holder to a position at which the print head is undetachable, as well as controlling a pressurizing supply unit to stop pressurization and supply ink from the ink tank to the print head.

12 Claims, 17 Drawing Sheets

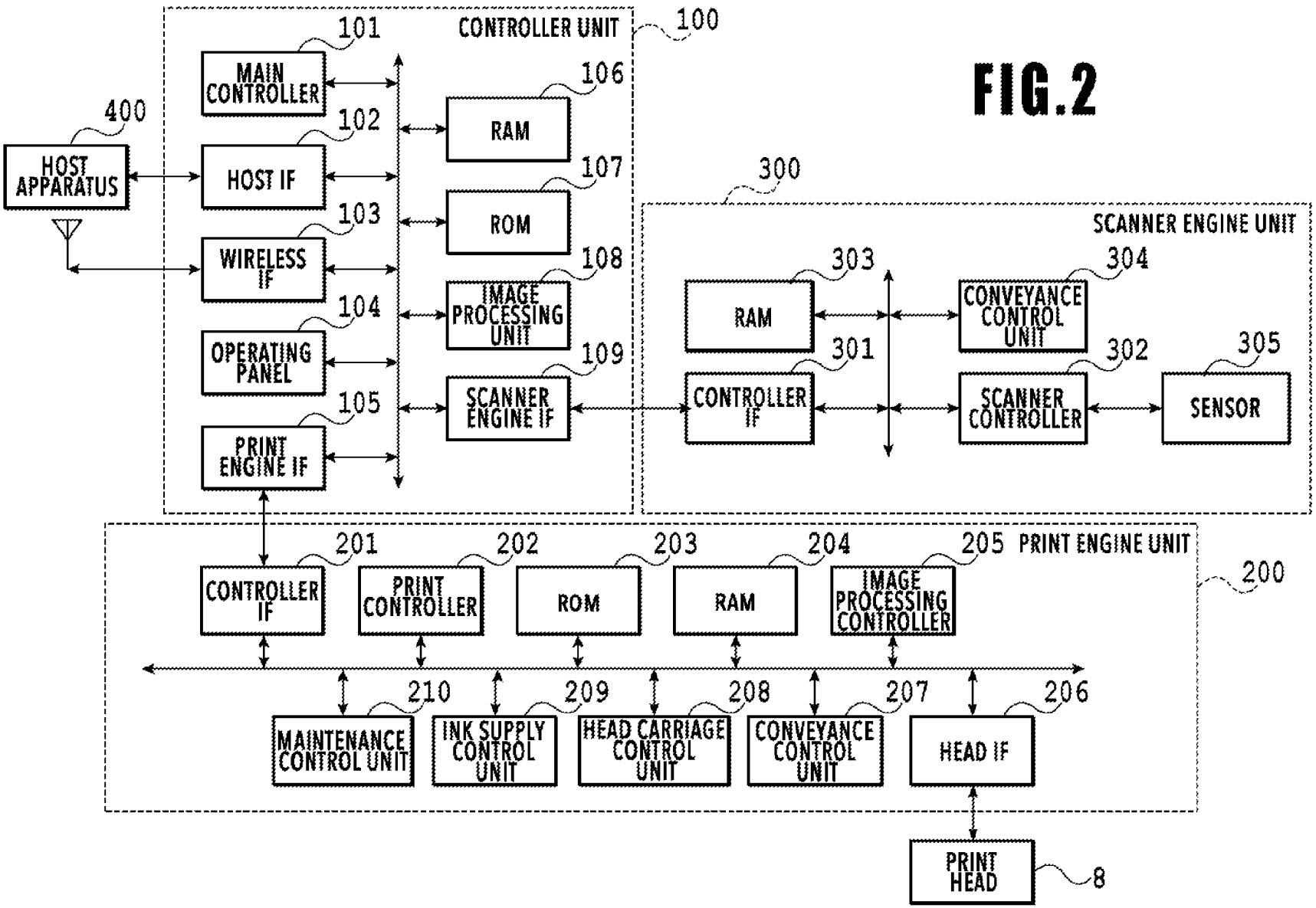
FIG.2
SCANNER ENGINE UNIT
300
SENSOR
305
CONVEYANCE CONTROL UNIT
304
SCANNER CONTROLLER
302
RAM
303
CONTROLLER IF
301
200
PRINT ENGINE UNIT
IMAGE PROCESSING CONTROLLER
205
HEAD IF
206
PRINT HEAD
8
RAM
204
CONVEYANCE CONTROL UNIT
207
ROM
203
HEAD CARRIAGE CONTROL UNIT
208
PRINT CONTROLLER
202
INK SUPPLY CONTROL UNIT
209
CONTROLLER IF
201
MAINTENANCE CONTROL UNIT
210
100
CONTROLLER UNIT
RAM
106
ROM
107
IMAGE PROCESSING UNIT
108
SCANNER ENGINE IF
109
MAIN CONTROLLER
101
HOST IF
102
WIRELESS IF
103
OPERATING PANEL
104
PRINT ENGINE IF
105
HOST APPARATUS
400

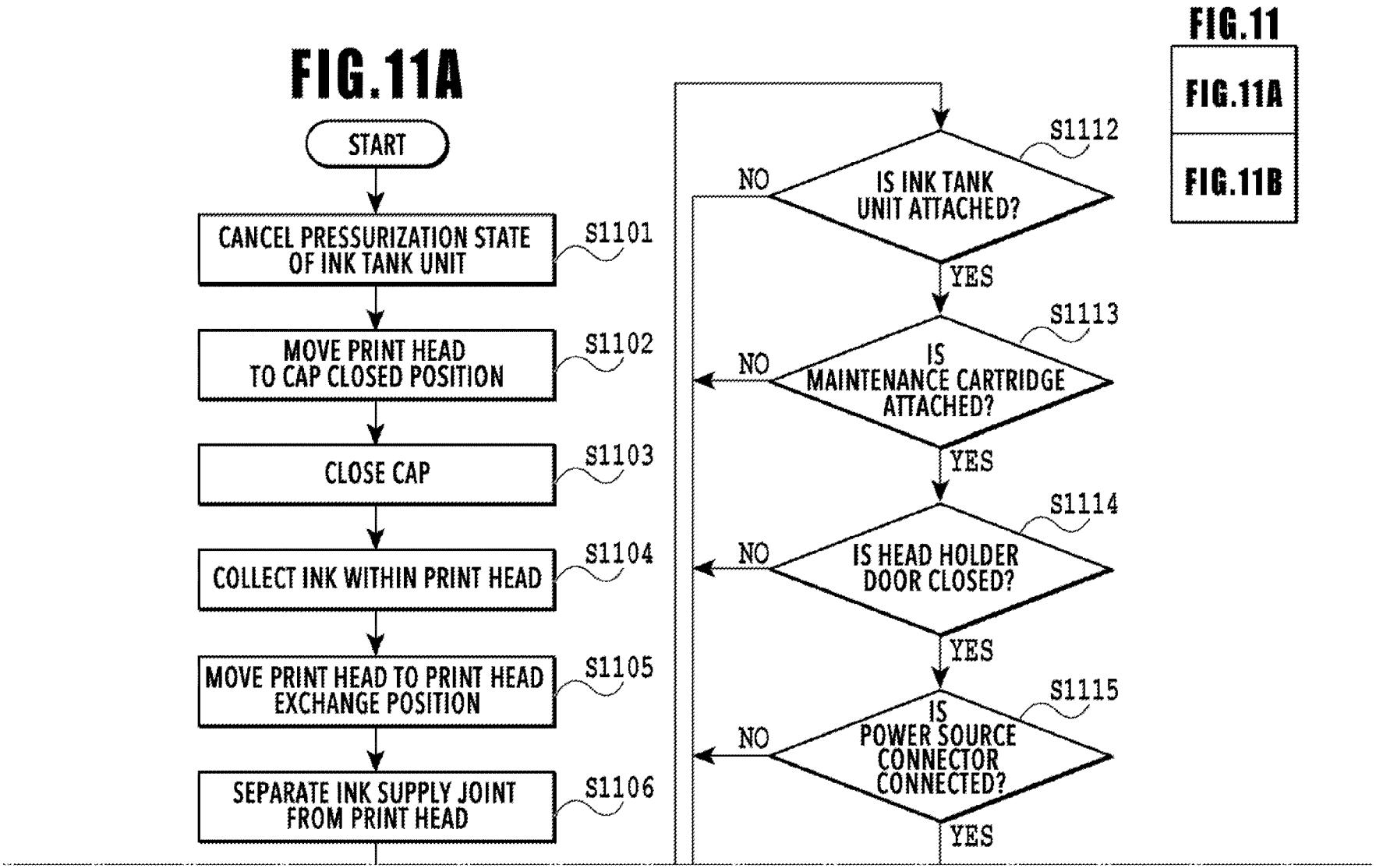
FIG.11
FIG.11A
FIG.11B
FIG.11A
START
S1101
CANCEL PRESSURIZATION STATE OF INK TANK UNIT
S1102
MOVE PRINT HEAD TO CAP CLOSED POSITION
S1103
CLOSE CAP
S1104
COLLECT INK WITHIN PRINT HEAD
S1105
MOVE PRINT HEAD TO PRINT HEAD EXCHANGE POSITION
S1106
SEPARATE INK SUPPLY JOINT FROM PRINT HEAD
S1112
IS INK TANK UNIT ATTACHED?
YES
NO
S1113
IS MAINTENANCE CARTRIDGE ATTACHED?
YES
NO
S1114
IS HEAD HOLDER DOOR CLOSED?
YES
NO
S1115
IS POWER SOURCE CONNECTOR CONNECTED?
YES
NO

PRINTING APPARATUS AND METHOD FOR CONTROLLING THE SAME

BACKGROUND OF THE INVENTION

Field of the Invention

The present invention relates to a printing apparatus including a print head that prints an image by ejecting ink and a method for controlling the same.

Description of the Related Art

The printing apparatus is requested to further increase the printing speed in order to improve productivity. As one of the techniques to increase the printing speed, mention is made of a pressurized supply system that supplies ink to the print head by using a pump or the like.

With the above-described pressurized supply system, in a case where an exchange-target device arranged in an ink flow path is detached by a user or the like during operation under an erroneous procedure, there is a possibility that a large amount of ink flows out, and therefore, various techniques to prevent an erroneous operation of a user are under study.

Japanese Patent No. 5566067 has disclosed a printing apparatus that prevents in advance a user from performing print head exchange under an erroneous procedure during operation. In this printing apparatus, in a case where a drive source by a motor or the like turns in a first turning direction, the print head exchange cover is closed and pressurization within the ink tank is started in an interlocking manner. Further, in a case where the drive source turns in a second turning direction, the print head exchange cover is opened and pressurization within the ink tank is cancelled in an interlocking manner.

In the printing apparatus of Japanese Patent No. 5566067, in a case where pressurization within the ink tank is cancelled in an attempt to exchange an ink tank, in an interlocking manner with this operation, the operation to open the print head exchange cover is performed. In such a case, the print head also enters a detachable state, and therefore, an environment is brought about in which it is possible for a user to exchange the print head erroneously, and therefore, this is not preferable from the fail-safe viewpoint.

SUMMARY OF THE INVENTION

The present invention provides a technique by which it is possible to easily perform an exchange work while preventing in advance an exchange work of an exchange-target device by a user under an erroneous procedure.

The printing apparatus according to an aspect of the present invention includes: a head holder that mounts a print head detachably; a holder moving unit configured to move the head holder to a first position at which the print head is detachable and to a second position at which the print head is undetachable; an ink tank, detachable from the apparatus, configured to store ink to be supplied to the print head; a pressurizing supply unit configured to pressurize and supply ink from the ink tank to the print head; an openable cover that covers the head holder and the ink tank; a lock unit capable of switching between a lock state where the cover is fixed to a closed position and an unlocked state where the cover is not fixed to the closed position; and a control unit configured to control, in a case of receiving instructions to detach the ink tank, the lock unit to switch to the unlocked state after controlling the holder moving unit to move the head holder to the second position, as well as controlling the pressurizing supply unit to stop pressurization.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIG. 11 is a diagram showing the relationship of FIG. 11A and FIG. 11B;

FIG. 11A and FIG. 11B are flowcharts at the time of a print head exchange work;

FIG. 12A is a diagram of a state where pressurization of an ink tank unit is cancelled. FIG. 12B is a diagram of a state where a print head is positioned at a cap closed position. FIG. 12C is a diagram of a state where a head is positioned at a head exchange position. FIG. 12D is a diagram of a state where a front door is unlocked;

FIG. 13A is a diagram of a state where the front door is opened. FIG. 13B is a diagram of a state where a head holder door is opened. FIG. 13C is a diagram showing a print head exchange state;

FIG. 15A is a diagram of a state where pressurization of the ink tank unit is cancelled. FIG. 15B is a diagram of a state where the print head is positioned at the cap closed position. FIG. 15C is a diagram of a state where the front door is unlocked. FIG. 15D is a diagram of a state where the front door is opened.

DESCRIPTION OF THE EMBODIMENTS

Figure 1:
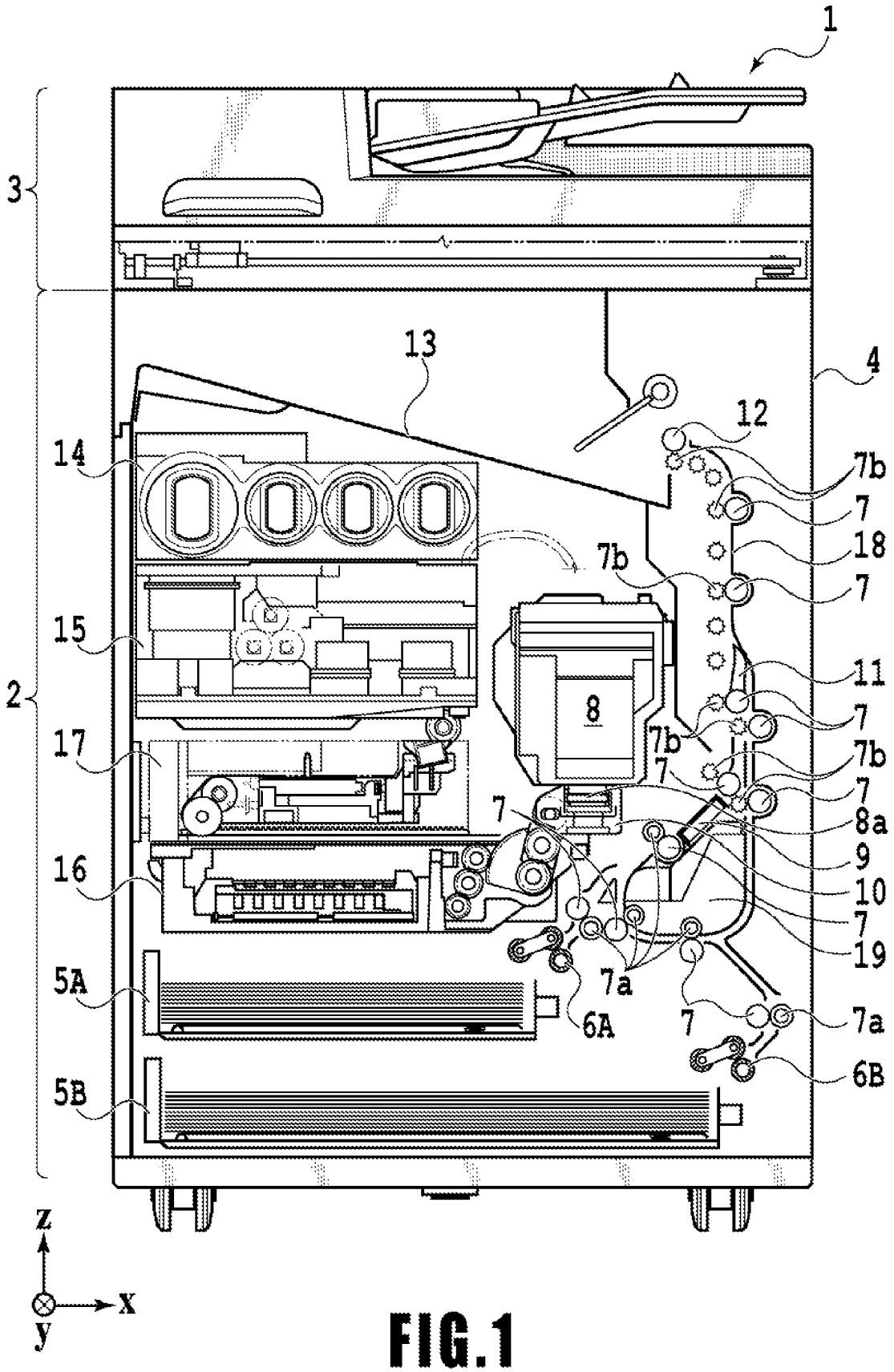
FIG. 1 is a diagram in a case where a printing apparatus is in a standby state.

An embodiment of the present invention will be described below with reference to the drawings. Note that the constituent components described in this embodiment are mere examples and are not intended to limit the scope of the present invention to those. Moreover, not all the combinations of the constituent components described in the embodiment are necessarily essential for a solution to the problem. Incidentally, the same reference numeral refers to the same component in the following description. Furthermore, relative positions, shapes, and the like of the constituent elements described in the embodiments are exemplary only and are not intended to limit the scope of the invention.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing medium (cut sheets) S are detachably provided at the bottom of a casing 4 in the vertical direction. Relatively small printing medium of up to A4 size are stacked and housed in the first cassette 5A and relatively large printing medium of up to A3 size are stacked and housed in the second cassette 5B. A first feeding unit 6A for feeding housed printing medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14, detachable from the apparatus, separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied from the ink tank unit 14 to the print head 8 is within a suitable range. That is, the ink supply control unit 209 corresponds to "a pressurizing supply unit" in the claims. A maintenance control unit 210 controls the operation of the cap unit 10 and the wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
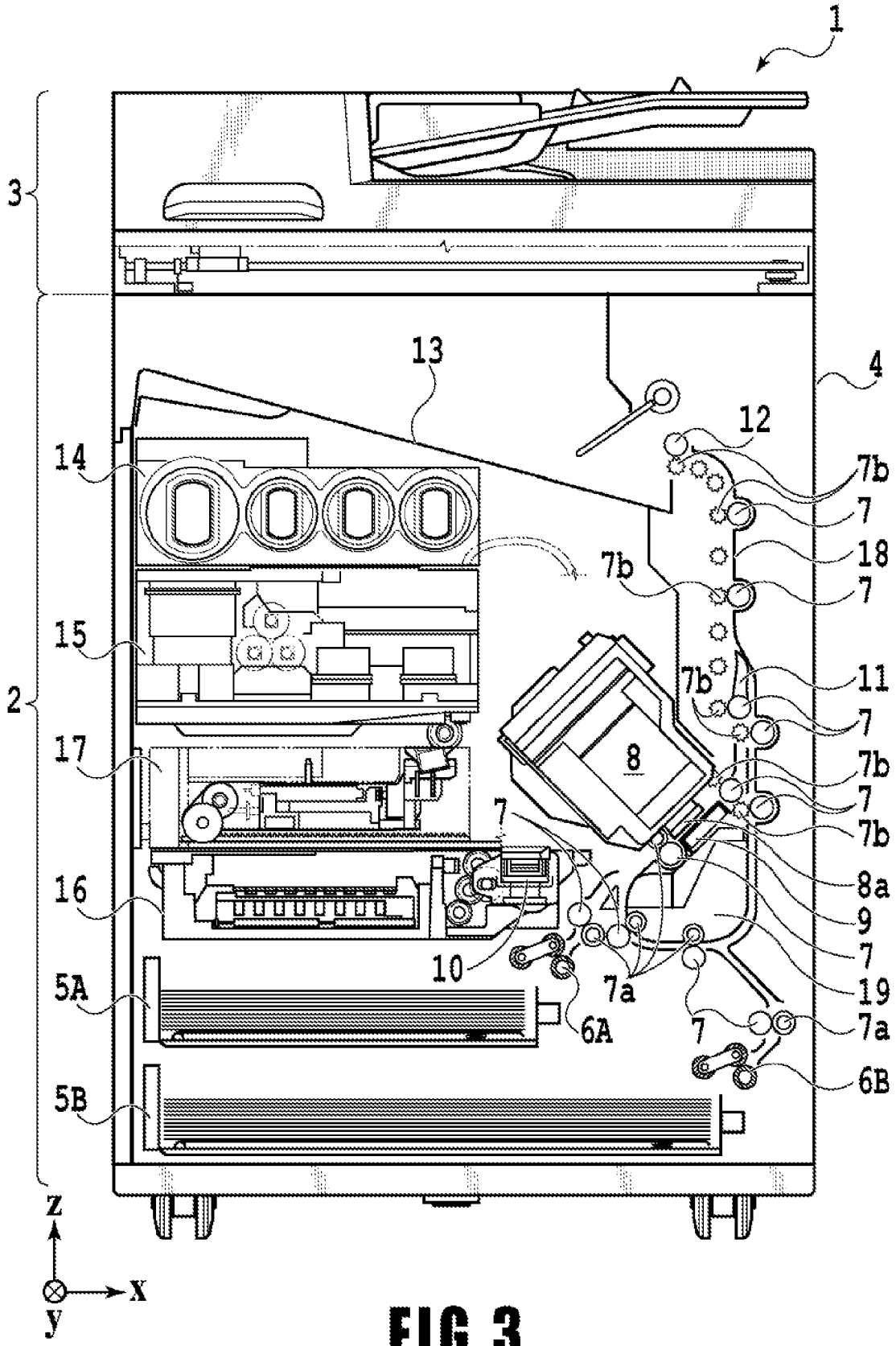
FIG. 3 is a diagram in a case where the printing apparatus is in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
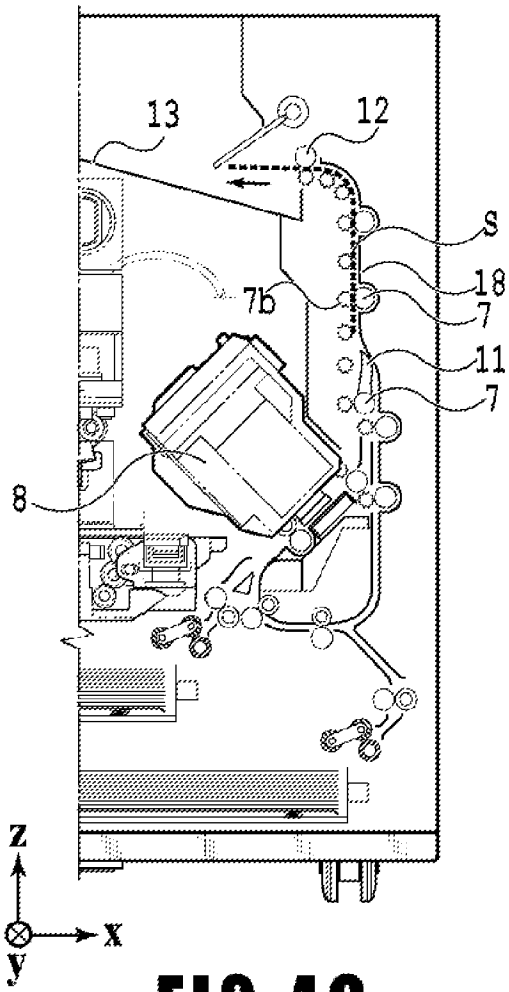
FIG. 4A to FIG. 4C are conveying path diagrams of a print medium fed from a first cassette.
Figure 4B:
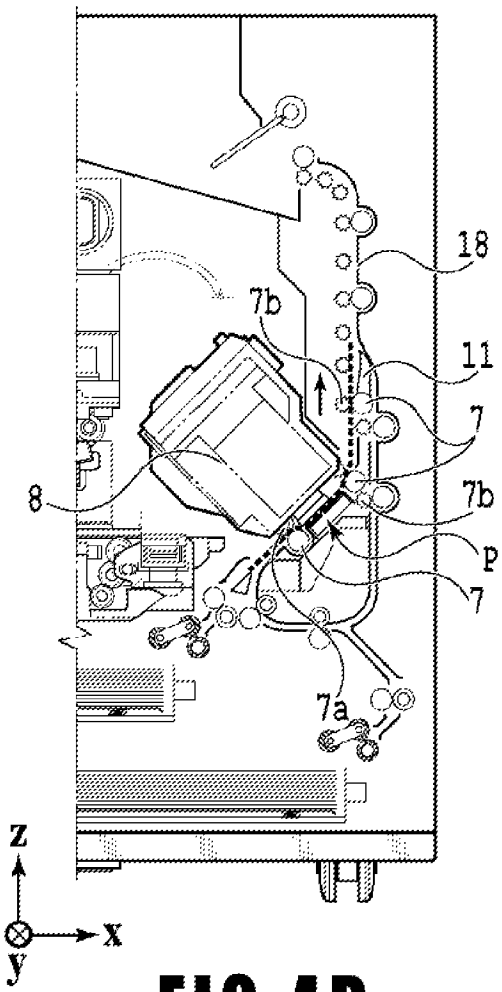
Figure 4A:
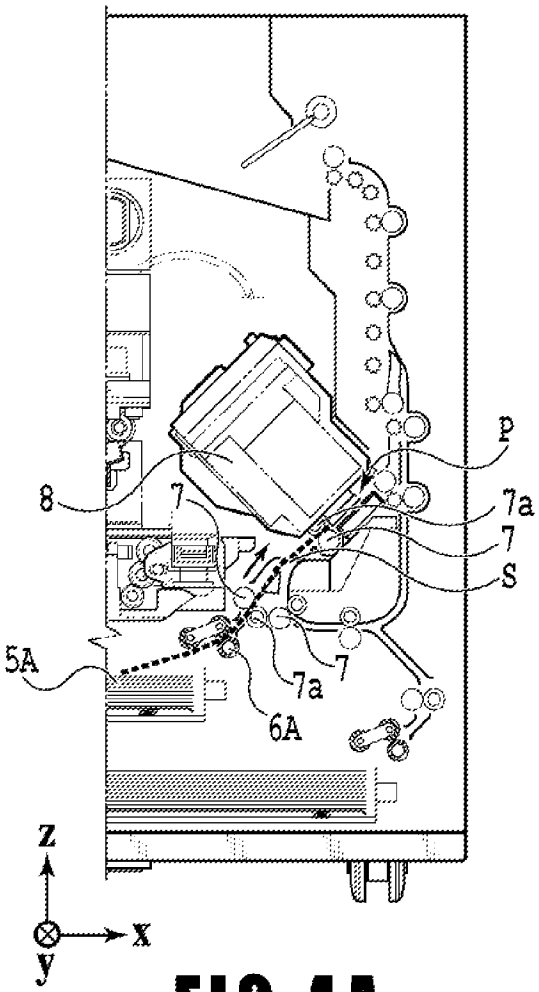

FIGS. 4A to 4C are diagrams showing a conveying path in the case of feeding an A4 size print medium S from the first cassette 5A. A print medium S at the top of a stack of printing medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
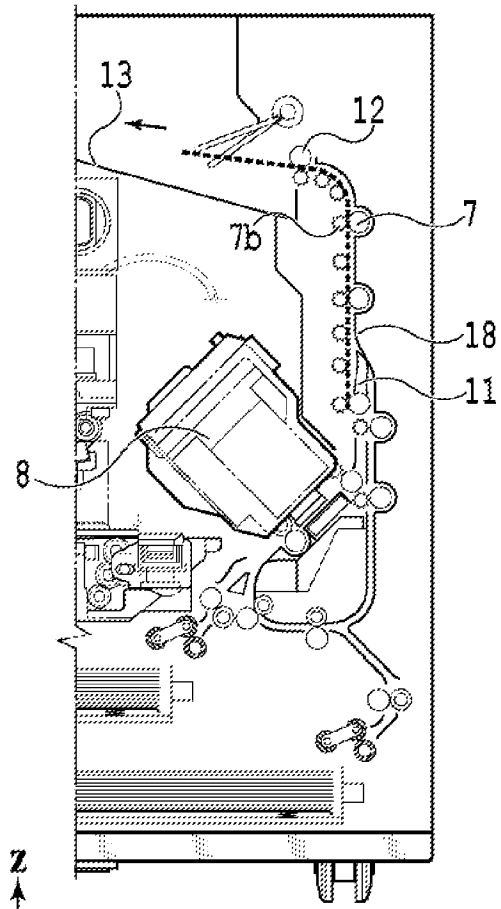
FIG. 5A to FIG. 5C are conveying path diagrams of a print medium fed from a second cassette.
Figure 5B:
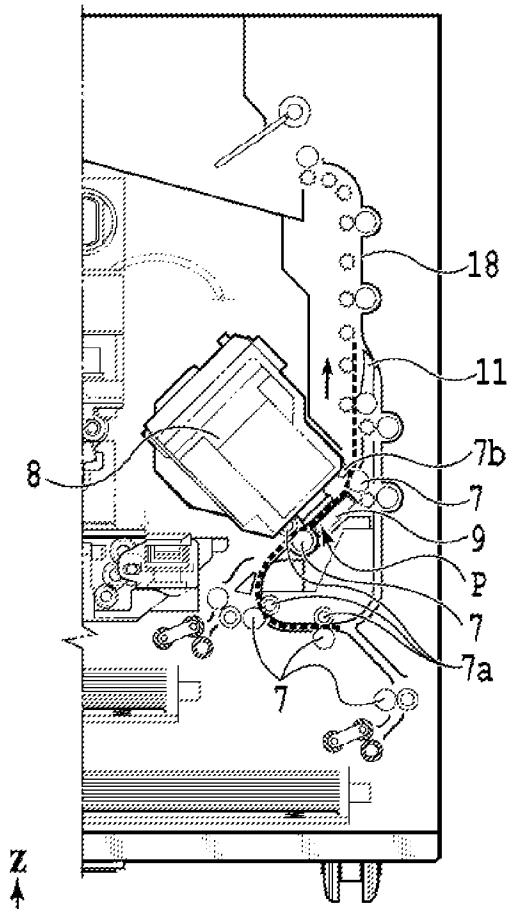
Figure 5A:
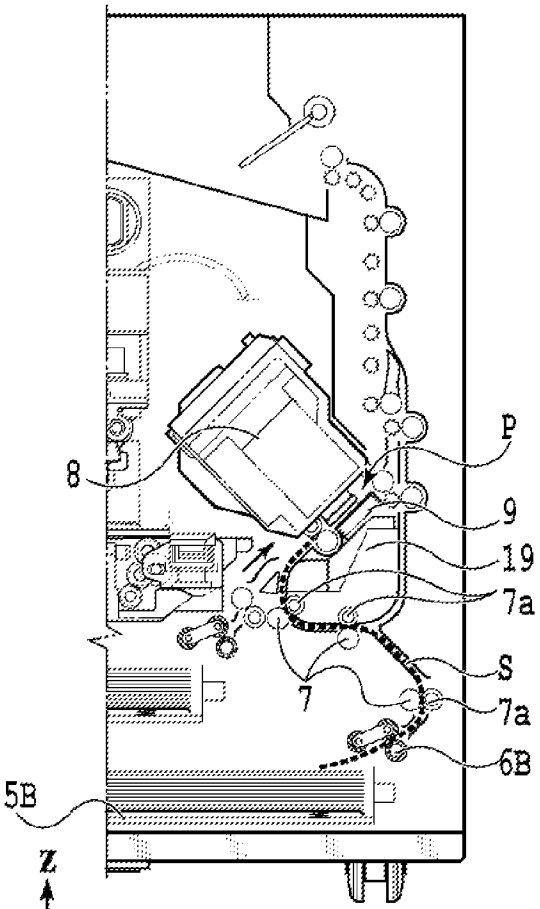

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
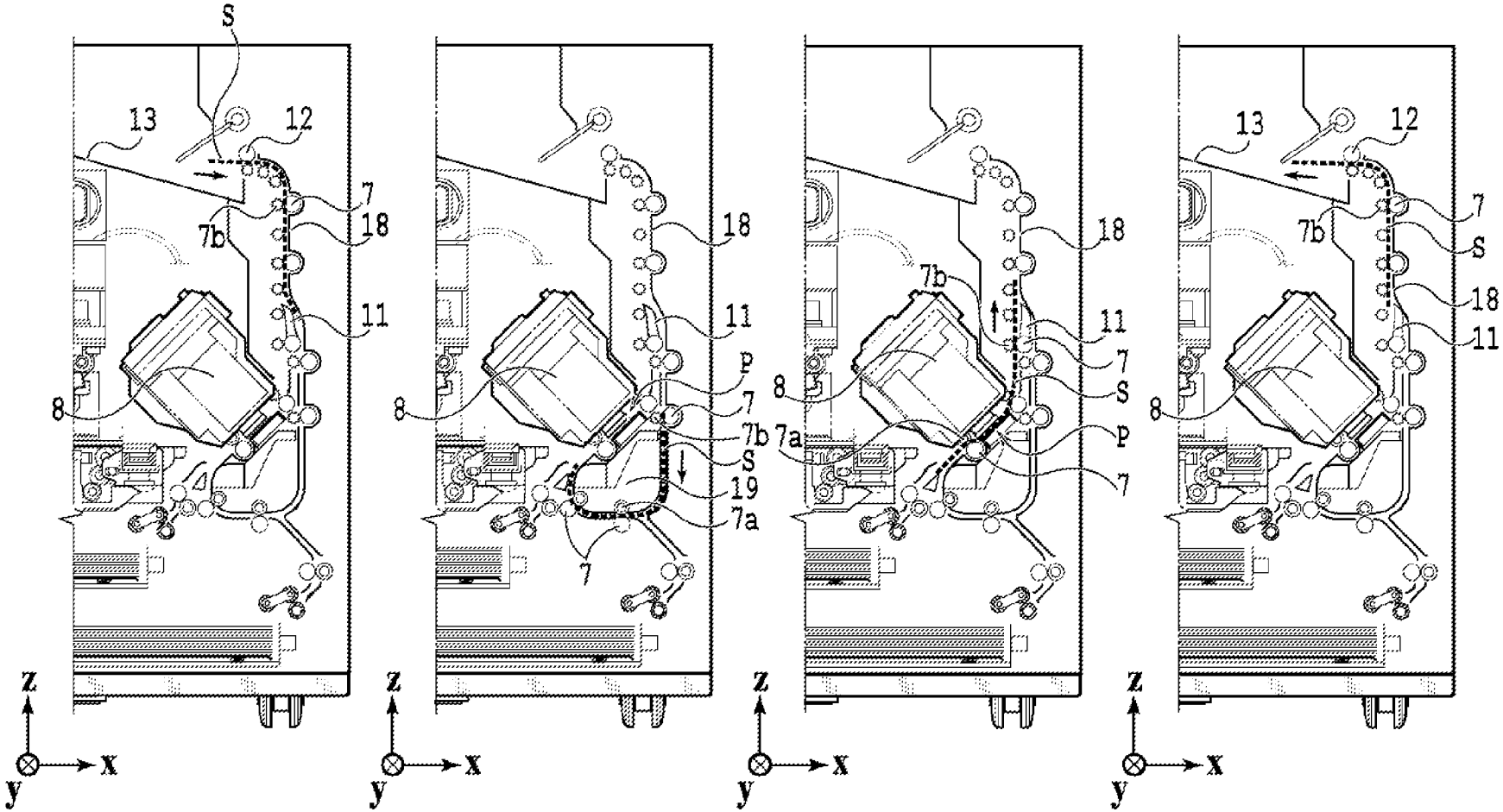
FIG. 6A to FIG. 6D are conveying path diagrams in a case where print operation is performed on the back side of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
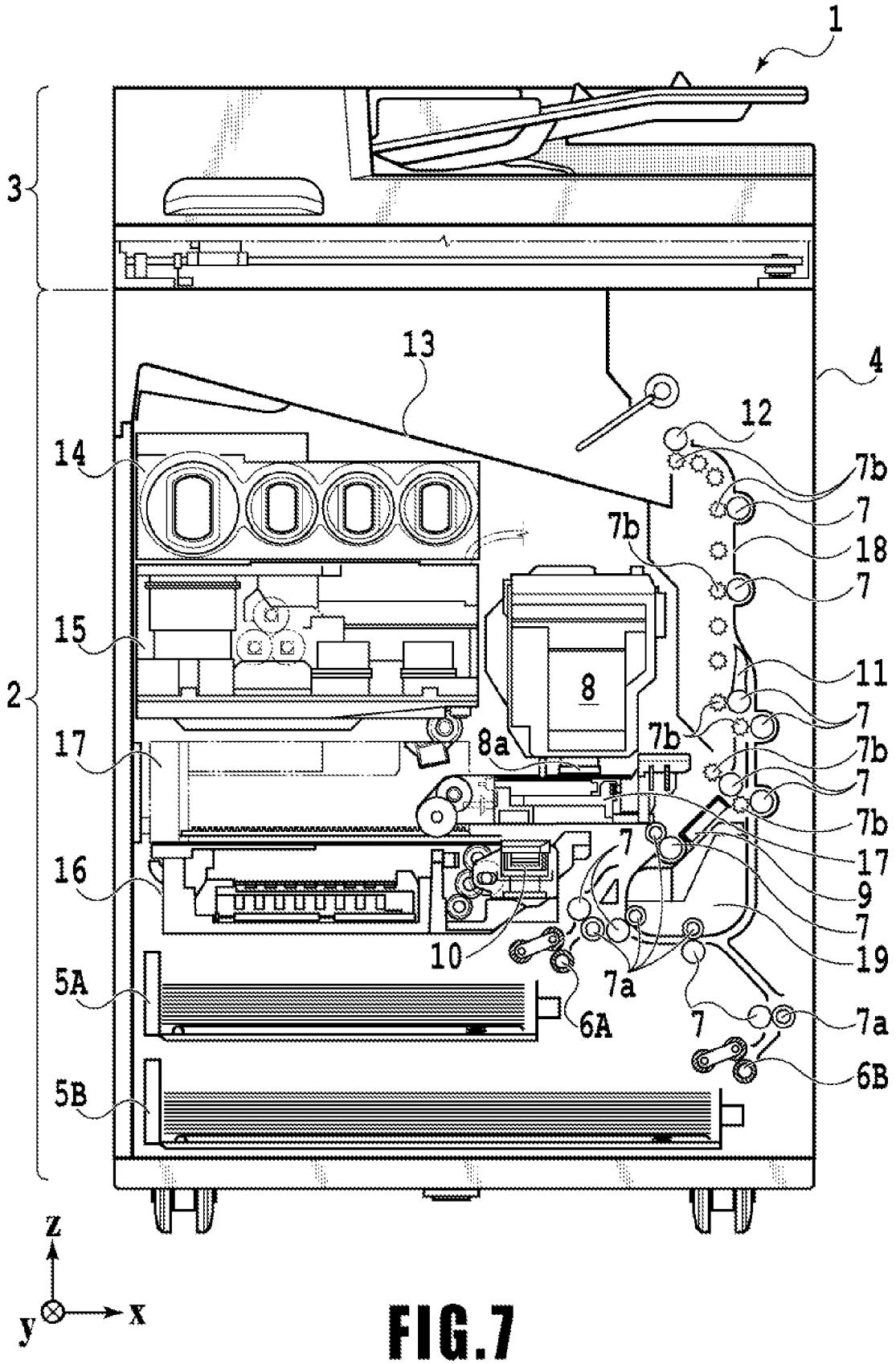
FIG. 7 is a diagram in a case where the printing apparatus is in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8A:
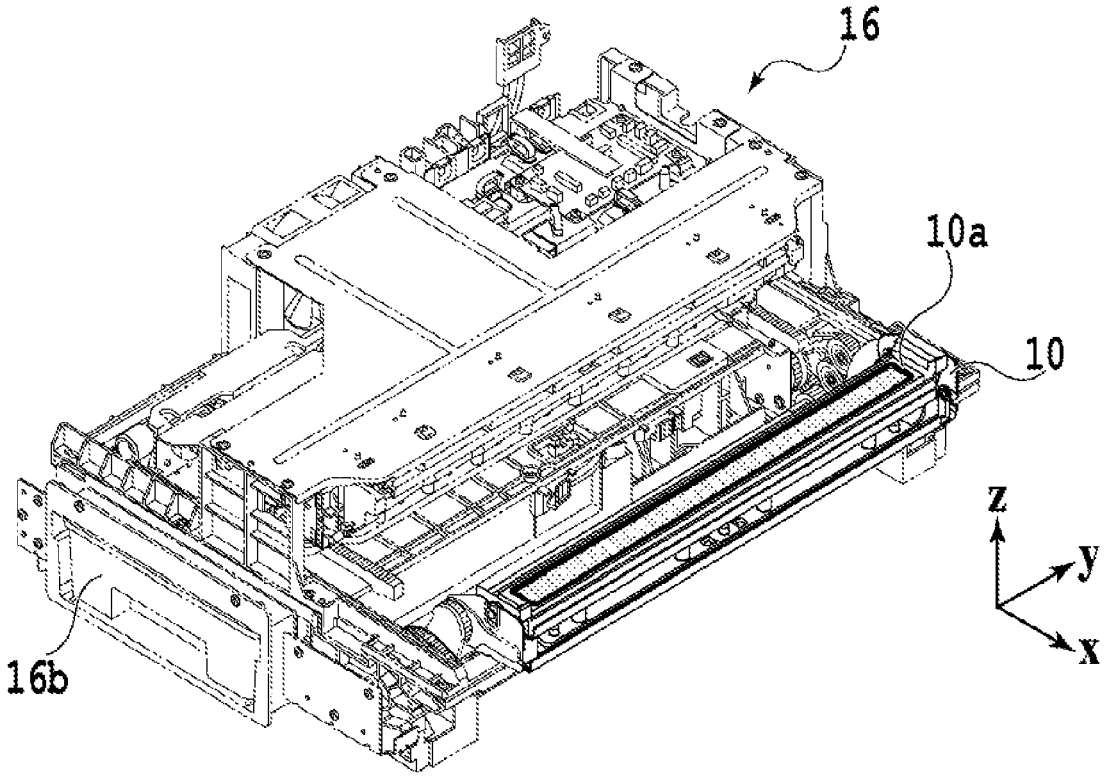
FIG. 8A and FIG. 8B are perspective diagrams showing a configuration of a maintenance unit.
Figure 8B:
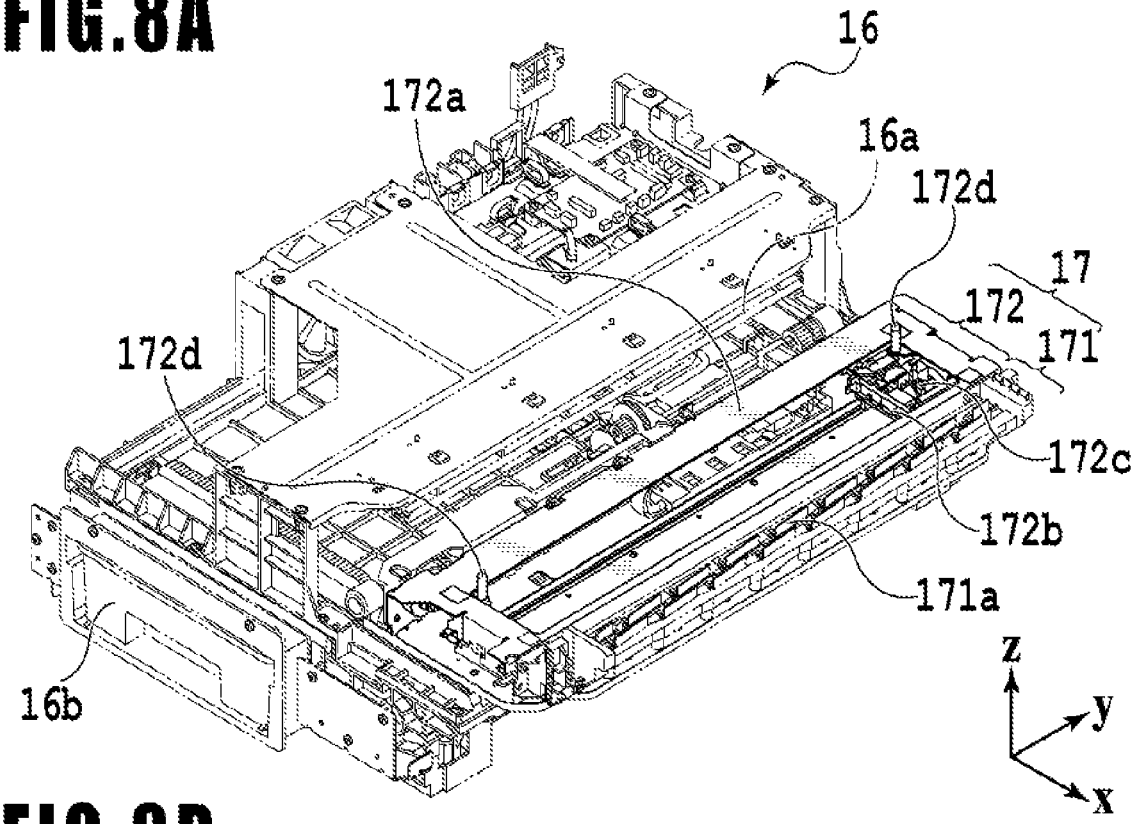

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink. The ink collected by the cap unit 10 is housed in a maintenance cartridge 16*b* (a waste ink storage unit). In a case where it is determined that amount of the ink exceeds a predetermined amount, a user is prompted to exchange work via the operating panel 104 or the like.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction along the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown).

Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

<About Structure Around Print Unit and Print Head of Printing Apparatus>

Next, in the present embodiment, the structure around the print unit 2 and the print head 8 of the printing apparatus 1 is explained.

Figure 9A:
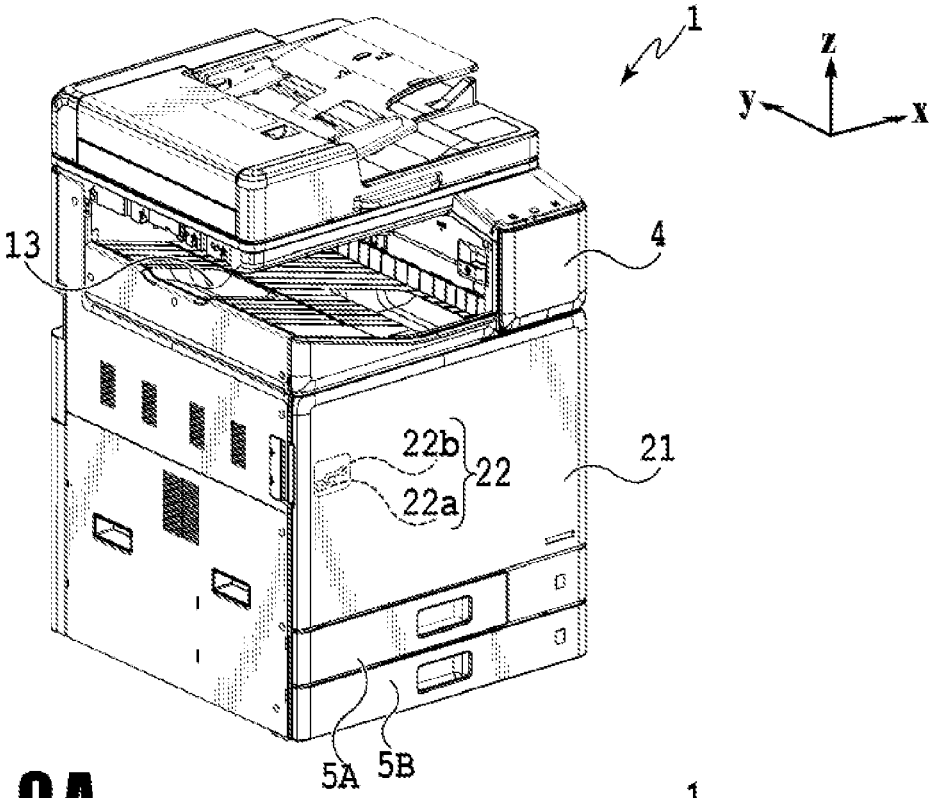
FIG. 9A and FIG. 9B are perspective diagrams of the printing apparatus.
Figure 9B:
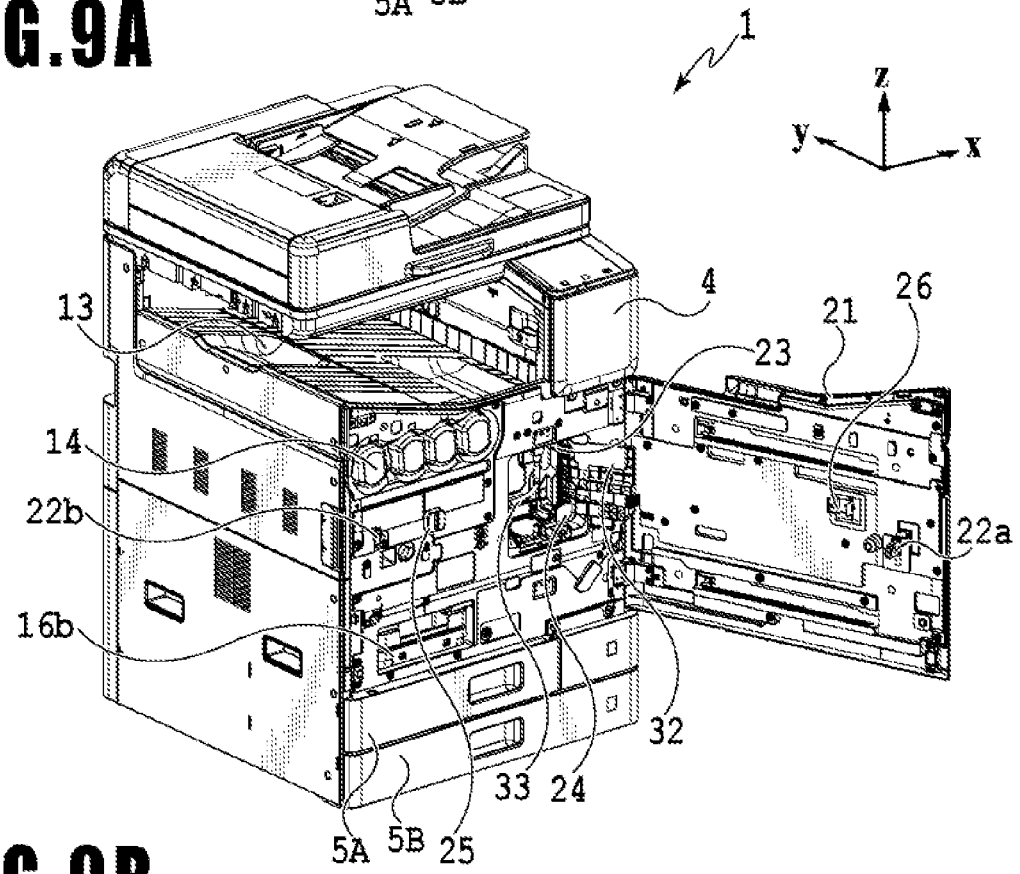

FIG. 9A is a perspective diagram of the printing apparatus in the state where a front door is closed. FIG. 9B is a perspective diagram of the printing apparatus in the state where the front door is opened.

The printing apparatus 1 includes a front door 21 that covers the entire range from the lower portion of the discharging tray 13 to the upper portion of the first cassette 5A on the front side of the print unit 2 of the casing 4. The front door 21 and the casing 4 are provided with a door latch 22*a* and a door hook 22*b* of a lock mechanism 22, respectively. The lock mechanism 22 has a structure that cancels the lock state of the front door 21 where the door latch 22*a* and the door hook 22*b* engage with each other only in a case of receiving instructions for predetermined operation at the closed position in the state where the front door 21 is closed. As the instructions for predetermined operation, mention is made of instructions for maintenance operation, such as device exchange accompanied by the work to open the front door 21 (front door open work). The instructions for maintenance operation include, for example, exchange of the print head 8, exchange of the ink tank unit 14, exchange of the maintenance cartridge 16, and so on. In a case where the lock state of the front door 21 is cancelled and an unlocked state is brought about, the front door 21 enters the state where it is possible to open and close the front door 21. Due to this, it is made possible for a user or the like to access the ink tank unit 14, the maintenance cartridge 16*b* of the maintenance unit 16, and so on, arranged in the print unit 2 from the front side of the casing 4. In a case where instructions for operation other than instructions for predetermined operation, such as instructions for maintenance operation, are received, the lock state of the front door 21 is not cancelled and the front door 21 is maintained in the state where the front door 21 covers the front side of the print unit 2 and it is not possible to open or close the front door 21 at the closed position in the closed state. Because of this, the front door 21 is maintained in the state where it is not possible for a user or the like to access the print head 8, the ink tank unit 14, the maintenance cartridge 16*b* of the maintenance unit 16, and so on, arranged in the print unit 2 from the front side of the casing 4. That is, the lock mechanism 22 is configured so as to be capable of switching between the lock state where the front door 21 is fixed at the closed position and the unlocked state where the front door 21 is not fixed at the closed position. The access by a user or the like to the print head 8 from the front side of the casing 4 is maintained in the state where the access is not possible until a predetermined condition is satisfied and predetermined operation is performed, as will be described later in detail.

Further, on the front side of the print unit 2 of the casing 4, an interlock mechanism 25 that engages with a protrusion 26 provided on the back side of the front door 21 is provided. The interlock mechanism 25 is configured so as to shut off supply of power to a holder moving device, to be described later, and the cap unit 10 in a state where the front door 21 is located at a position opened from the closed position by a user or the like and the engagement with the protrusion 26 is cancelled. The holder moving device moves a head holder 31 (see FIG. 10). The interlock mechanism 25 is configured so that power is supplied to the holder moving device and the cap unit 10 in a state where the front door 21 is closed and located at the closed position and the interlock mechanism 25 engages with the protrusion 26. By including the interlock mechanism 25, which is a shutoff device that performs such shutoff operation, in a case where the front door 21 is opened and the engagement with the protrusion 26 is cancelled, supply of power to the holder moving device and the cap unit 10 is shut off. Due to this, a state is brought about where the function of moving operation of the head holder 31 by the holder moving device and the function of suction operation of ink by the cap unit 10 are disabled, and therefore, the front side of the casing 4, which is covered by the front door 21, enters an environment in which it is easy for a user or the like to work. The mechanism for prohibiting functions, which disables the function of moving operation of the head holder 31 by the holder moving device and the function of suction operation of ink by the cap unit 10, is not limited to the interlock mechanism. For example, it is also possible to use a circuit that switches the operation of the holder moving device and the cap unit 10 based on a signal that detects the open/closed state of the front door 21.

Figure 10A:
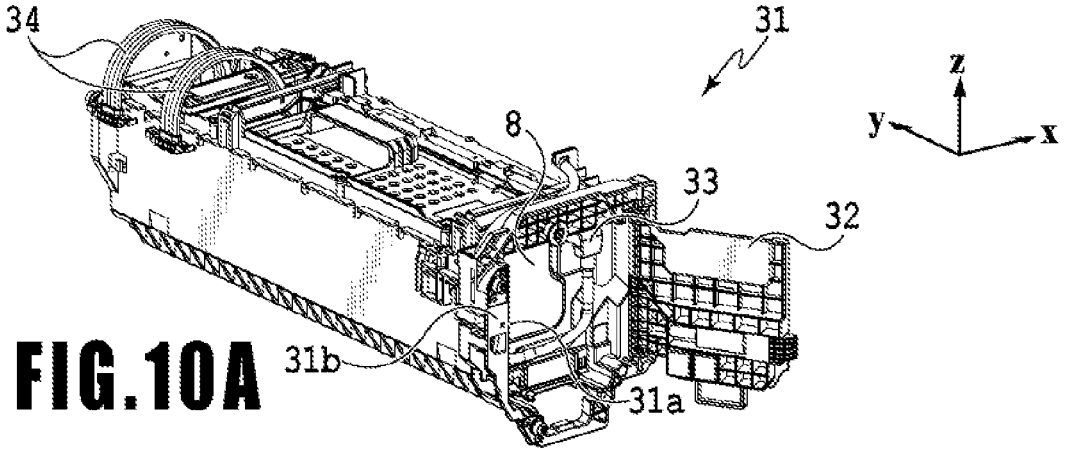
FIG. 10A to FIG. 10D are perspective diagrams showing a configuration of a head holder.
Figure 10B:
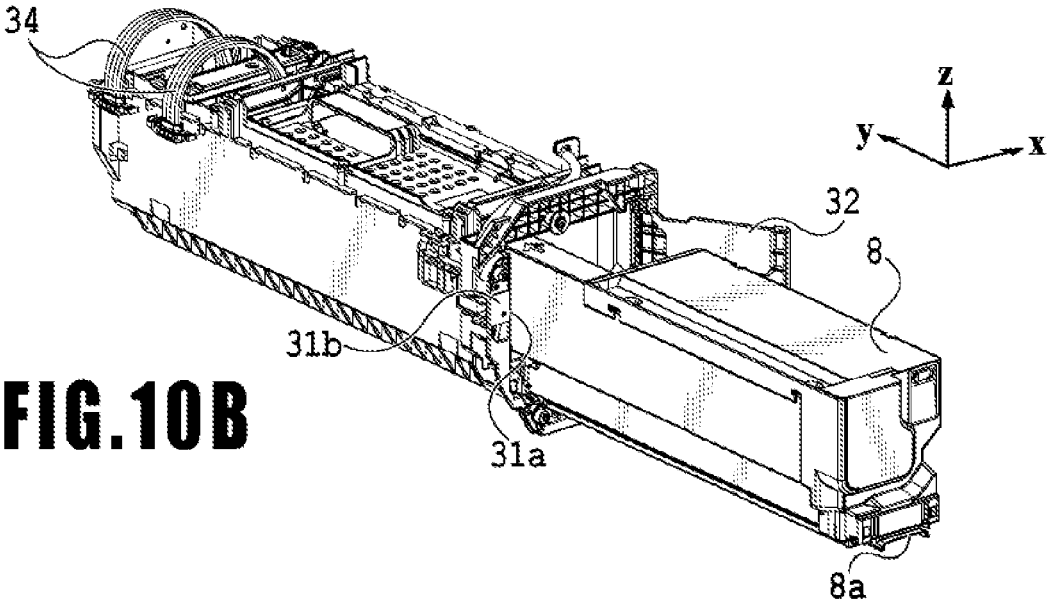
Figure 10C:
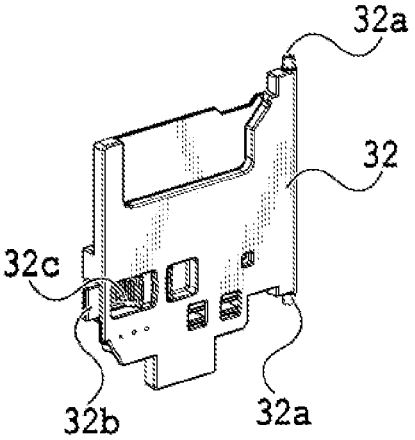
Figure 10D:
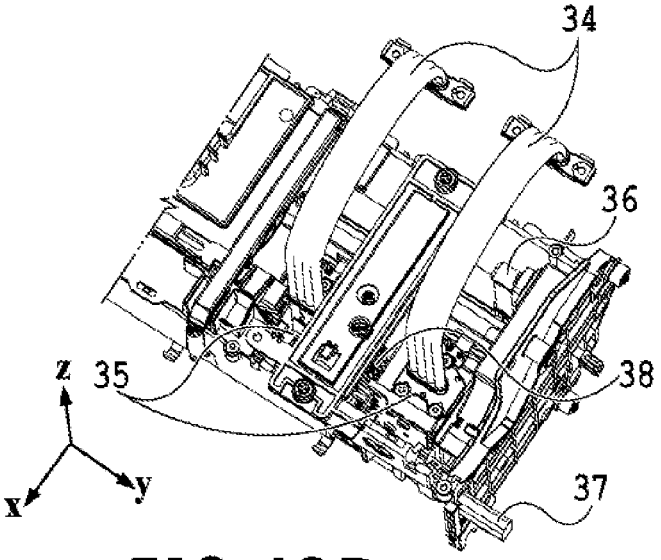

FIG. 10A is a perspective diagram of the head holder. FIG. 10B is a perspective diagram in the state where the print head is drawn from the head holder. FIG. 10C is a perspective diagram of a head holder door. FIG. 10D is a partially enlarged diagram of the head holder.

The print head 8 is mounted on the head holder 31 having the shape of a box extending in the y-direction. The head holder 31 is provided with an opening 31*a* at one end portion in the y-direction and the head holder 31 has a structure in which it is possible to detach the print head 8 through the opening 31*a*. That is, the head holder 31 has a structure in which it is possible for a user to mount the print head 8 by sliding the print head 8 in the y-direction and pushing the print head 8 into the head holder 31 through the opening 31*a*, or to detach the print head 8 by drawing the print head 8 from the inside through the opening 31*a*. A frame portion 31*b* around the opening 31*a* of the head holder 31 is provided with a head holder door 32 capable of turning with a rotation axis 32*a* as a center. That is, the head holder 31 is provided with the head holder door 32 capable of opening at the time of detachment of the print head 8. The head holder 32 is provided with a lock plate 32*b* and a head holder door unlock slide lever (hereinafter, described as a slide lever) 32*c* for performing slide operation of the lock plate 32*b*. At the closed position in the state where the head holder door 32 is closed, by the operation of the slide lever 32*c*, the tip portion of the lock plate 32*b* protrudes to the outside of the head holder door 32 and engages with the frame portion 31*b* of the head holder 31. Due to this, a state is brought about where the head holder door 32 is locked. By positioning the tip portion of the lock plate 32*b* at a position at which the tip portion does not protrude to the outside of the head holder door 32 by sliding the lock plate 32*b* by the operation of the slide lever 32*c*, a state is brought about where the head holder door 32 is unlocked. It is possible to detect the open/closed state of the head holder door 32 by a sensor or the like, not shown schematically.

In the vicinity of the opening 31*a* of the head holder 31, a head signal cable 33 capable of performing transmission and reception of a signal between the print head 8 side and the casing 4 side is arranged. The head signal cable 33 is configured so as to be capable of connecting with and disconnecting from the print head 8 side and moving by the work of a user or the like, and at the time of the print head 8 exchange work, the connection with the print head 8 side is cancelled. In the vicinity of the other end portion on the opposite side of the opening 31*a* of the head holder 31 in the y-direction, an ink supply joint unit 35 to which one end portion of an ink supply tube 34 is connected is arranged. The ink supply joint unit 35 is configured so as to connect with and disconnect from the head holder 31 side by the action of a joint drive unit 38. The other end portion of the ink supply tube 34 is connected to the ink supply path of the casing 4. In the vicinity of the ink supply joint unit 35 within the head holder 31, a power source connector 36 that is connected to the mounted print head 8 side is arranged. The power source connector 36 connects with the power source supply circuit of the casing 4 via a power source supply cable 37 provided outside the head holder 31.

The head holder 31 is capable of moving to the positions, such as the printing position, the standby position, the maintenance position, the cap closed position, and the print head exchange position (first position), to be described later, by a holder moving device, not shown schematically. The maintenance cartridge 16*b* is an ink storage unit that is connected with the cap unit 10 and detachable from the casing 4 (maintenance unit 16). In the present embodiment, in a case where the print head 8 is located at the above-described maintenance position, the above-described suction pump (ink moving unit) is controlled so that the ink ejected from the print head 8 is moved from the cap unit 10 to the maintenance cartridge 16*b*. It is possible to detect the attached/detached state of the maintenance cartridge 16*b* to and from the casing 4 by a sensor or the like, not shown schematically.

<About Print Head Exchange>

Next, details of the processing at the time of exchanging the print head in the present embodiment are explained.

Figure 11B:
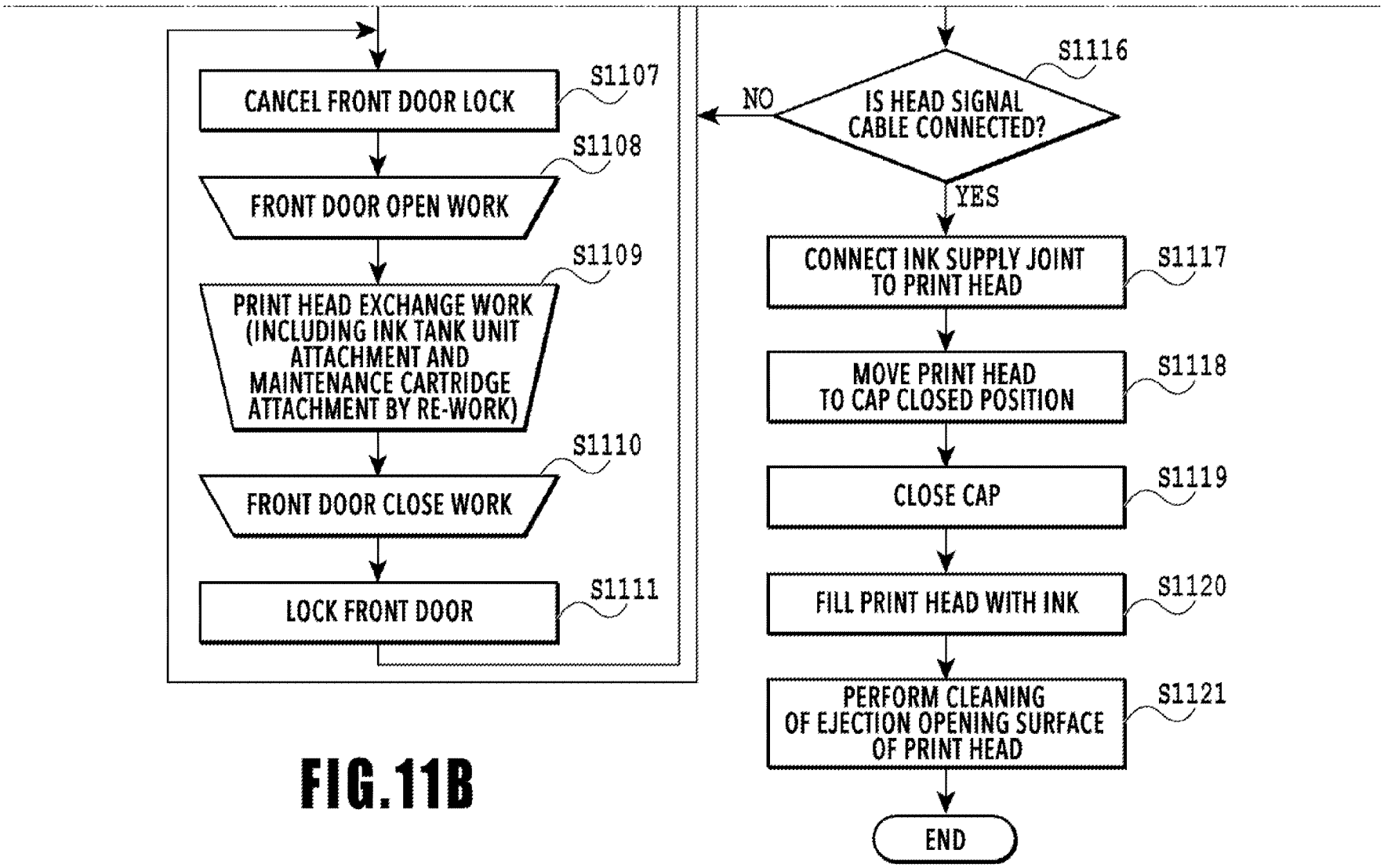

FIG. 11A and FIG. 11B are flowcharts at the time of the print head exchange work accompanied by the front door open work. The sequence at the time of the print head exchange work shown in FIG. 11A and FIG. 11B is performed by a maintenance control unit 210 based on instructions from a user. Instructions from a user are received through the operating panel 104 or the like. Symbol "S" in the explanation of each piece of processing indicates that the step is a step in the flow chart.

Figure 12A:
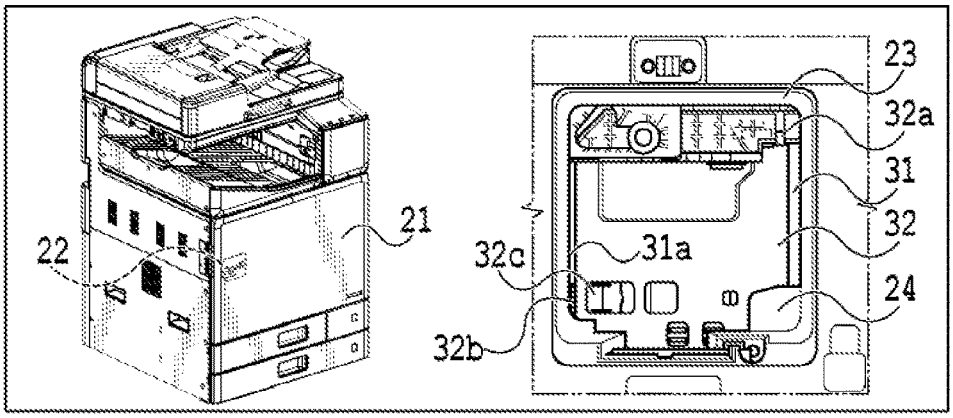
FIG. 12A to FIG. 12D are explanatory diagrams until a front door lock cancelled state.

At S1101, the maintenance control unit 210 causes the ink supply control unit 209 to perform processing to cancel the pressurization state of the ink tank unit 14. The ink supply control unit 209 stops to pressurize and supply ink from the ink tank unit 14 to the print head 8 and opens the inside of the ink supply path to the atmosphere. Due to this, the ink tank unit 14 enters a state where pressurization is cancelled. FIG. 12A is an explanatory diagram of the entire printing apparatus and the periphery of the opening on the front side of the printing apparatus in the state where the pressurization of the ink tank unit is cancelled. As shown in the left diagram in FIG. 12A, the state is the lock state where the door hook 22*b* of the lock mechanism 22 of the front door 21 engages with the door latch 22*a*. The front door 21 is fixed in the state where the front door 21 covers the entire range from the lower portion of the discharging tray 13 to the upper portion of the first cassette 5A on the front side of the casing 4. As shown in the right diagram in FIG. 12A, on the periphery of the opening on the front side of the casing 4 covered by the front door 21, the head holder 31 (print head 8) does not coincide in height with the opening 23 in the height direction and is held in the state where part of the head holder 31 overlaps the lower portion of the opening 23. Because of this, even in a case where a user tries to open the head holder door 32 in an attempt to exchange the print head 8, the movement of the head holder door 32 from the closed position to an open position is limited and blocked by a regulating plate 24. That is, the regulating plate 24 configured to regulate, in a case where the head holder 31 is arranged at a position other than the first position, the head holder door 32 from changing into an open state. As a result of this, the access to the print head 8 by a user is prevented. At the time of the processing at S1101, the arrangement position of the head holder 31 (print head 8) is not limited to the position shown in the right diagram in FIG. 12A and the arrangement position may be the printing position, the print head exchange position, and so on.

Figure 12B:
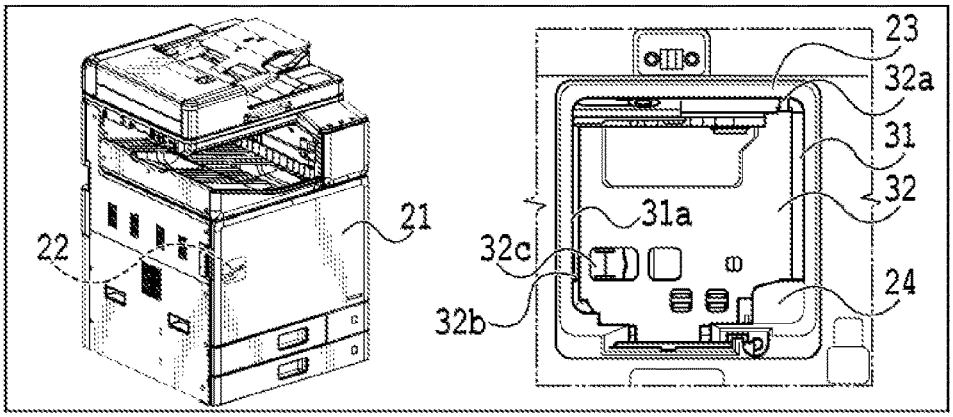

At S1102, the maintenance control unit 210 moves, in a case where the pressurization state of the ink tank unit 14 is cancelled by the pressure relief processing of the ink tank unit 14, the print head 8 to the cap closed position. The cap closed position is a middle position above the position at the time of the pressure relief processing and lower than the print head exchange position, to be described later. FIG. 12B is an explanatory diagram of the entire printing apparatus and the periphery of the opening on the front side of the printing apparatus in the state where the print head is moved to the cap closed position. As shown in the right diagram in FIG. 12B, on the front side of the casing 4 covered by the front door 21, the head holder 31 (print head 8) is held in the state where part of the head holder 31 overlaps the lower portion of the opening 23 in the height direction. Because of this, even in a case where a user tries to open the head holder door 32 in an attempt to exchange the print head 8, the movement of the head holder door 32 to an open position is limited and blocked by the regulating plate 24, and therefore, the access to the print head 8 by a user is prevented. The door hook 22*b* of the lock mechanism 22 of the front door 21 is maintained in the lock state where the door hook 22*b* engages with the door latch 22*a*. The front door 21 is fixed in the state where the front door 21 covers the enter range from the lower portion of the discharging tray 13 to the upper portion of the first cassette 5A on the front side of the casing 4.

At S1103, the maintenance control unit 210 closes the cap by causing the cap member 10*a* to come into contact with the ejection opening surface 8*a* of the print head 8.

At S1104, the maintenance control unit 210 sucks the ink within the print head 8 by a suction pump, not shown schematically. By returning the ink sucked from within the print head 8 to the ink supply unit 15, the waste ink is reduced.

Figure 12C:
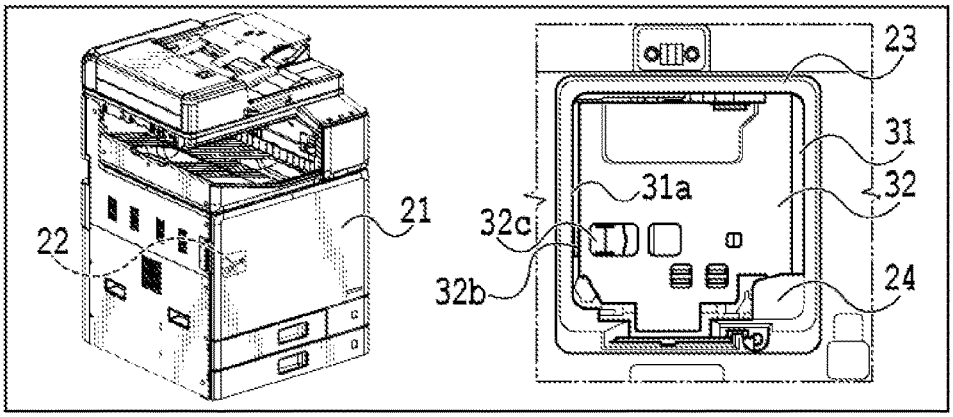

At S1105, the maintenance control unit 210 moves, in a case of detecting the completion of the collection processing of the ink within the print head at S1104, the print head 8 to the print head exchange position. The print head exchange position is a position above the cap closed position and at which the head holder 31 becomes flush with the opening 23 of the casing 4. FIG. 12C is an explanatory diagram of the entire printing apparatus and the periphery of the opening on the front side of the printing apparatus in the state where the print head is moved to the print head exchange position. As shown in the right diagram in FIG. 12C, on the front side of the casing 4 covered by the front door 21, the print head 8 moves upward compared to the position at S1102 in the height direction and is held at the position at which the print head 8 coincides in height with the opening 23. That is, the print head 8 does not overlap the lower portion of the opening 23 in the height direction, and therefore, the print head 8 is held at the position at which the movement of the head holder door 32 to an open position is not regulated by the regulating plate 24. The door hook 22*b* of the lock mechanism 22 of the front door 21 is maintained in the lock state where the door hook 22*b* engages with the door latch 22*a* as shown in the left diagram in FIG. 12C.

At S1106, the maintenance control unit 210 causes the joint drive unit 38 to go into action and separate the ink supply joint unit 35 from the print head 8. Due to this, the connection of the ink supply tube 34 with the print head 8 side is cancelled.

By the processing at S1101 to S1106 being performed, the open condition of the front door 21 at the time of the print head exchange work is satisfied. That is, the access condition of a user or the like for the portion covered by the front door 21 is satisfied and a state is brought about where it is possible for a user or the like to perform the print head 8 exchange work.

Figure 12D:
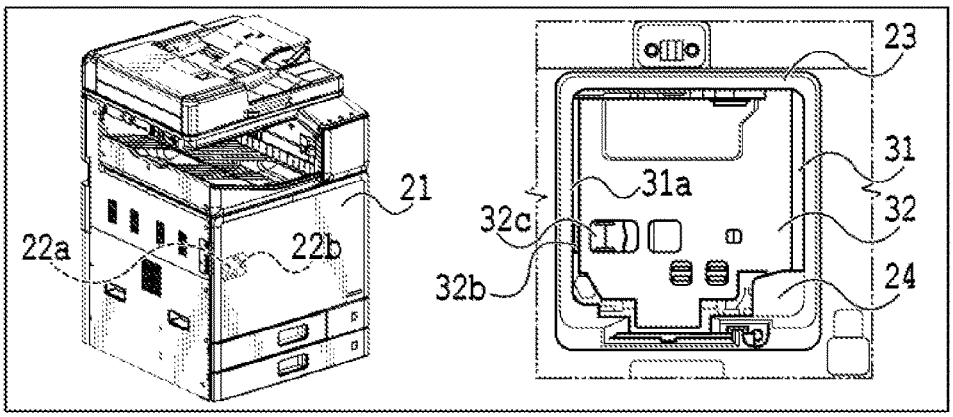

At S1107, the maintenance control unit 210 cancels the lock state of the front door 21. FIG. 12D is an explanatory diagram of the entire printing apparatus and the periphery of the opening on the front side of the printing apparatus in the state where the front door is unlocked. As shown in the left diagram in FIG. 12D, the door hook 22*b* of the lock mechanism 22 of the front door 21 is in the state where the engagement with the door latch 22*a* is cancelled and the front door 21 is held in the state where it is possible to open and close the front door 21 for the front side of the casing 4. On the front side of the casing 4 covered by the front door 21, as shown in the right diagram in FIG. 12D, the print head 8 coincides in height with the opening 23 in the height direction and is held in the state where the print head 8 is positioned at S1105.

Figure 13A:
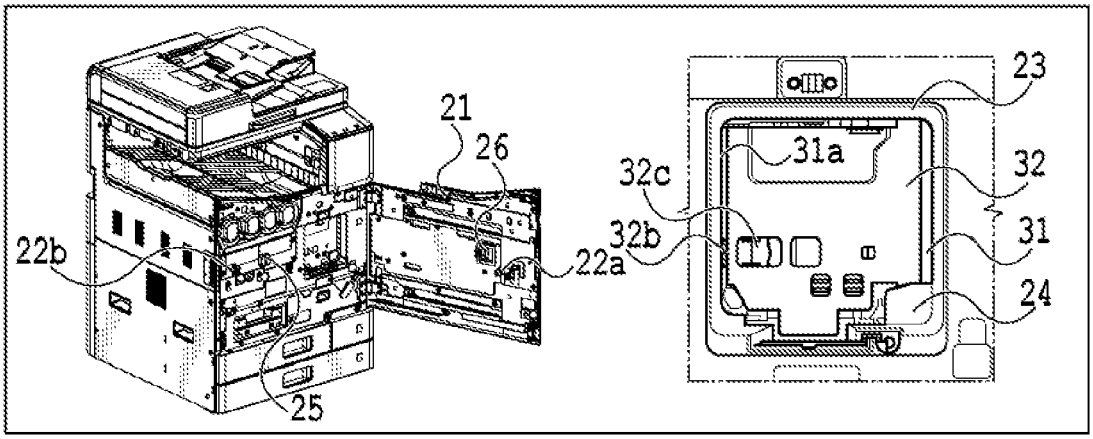
FIG. 13A to FIG. 13C are explanatory diagrams until a print head exchange state.

At S1108, a user or the like opens the front door 21. FIG. 13A is an explanatory diagram of the entire printing apparatus and the periphery of the opening on the front side of the printing apparatus in the state where the front door is opened. As shown in the left diagram in FIG. 13A, a state is brought about where the front door 21 is opened. By this work, a state is brought about where the engagement between the interlock mechanism 25 and the protrusion 26 is cancelled, and therefore, supply of power to the holder moving device and the cap unit 10 is shut off. On the front side of the casing 4 covered by the front door 21, as shown in the right diagram in FIG. 13A, the head holder 31 (print head 8) coincides in height with the opening 23 in the height direction and is held in the state where the head holder 31 is positioned at S1105.

Figure 13B:
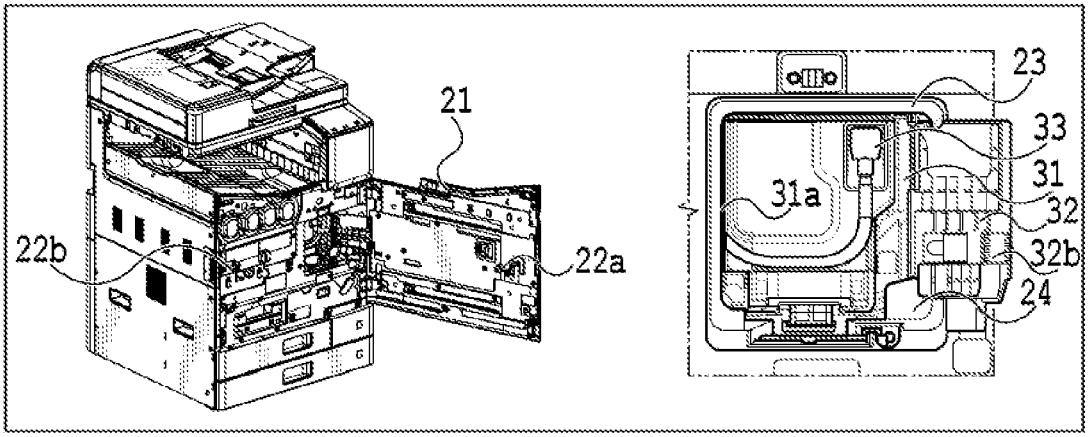

At S1109, the print head 8 exchange work is performed by a user or the like. First, the draw preparation work of the print head 8 is performed by a user or the like. A user operates the slide lever 32*c* to cancel the lock state of the head holder door 32 by the lock plate 32*b* and opens the head holder door 32. FIG. 13B is an explanatory diagram of the entire printing apparatus and the periphery of the opening on the front side of the printing apparatus in the state where the head holder door is opened by the print head exchange work. As shown in the left diagram and the right diagram in FIG. 13B, by the operation of the slide lever 32*c*, the lock state of the head holder door 32 by the lock plate 32*b* is cancelled and the head holder door 32 is opened by a user or the like. Next, a user cancels the connection of the head signal cable 33 with the print head 8 side. Due to this, a state is brought about where it is possible to draw the print head 8 from the head holder 31.

Figure 13C:
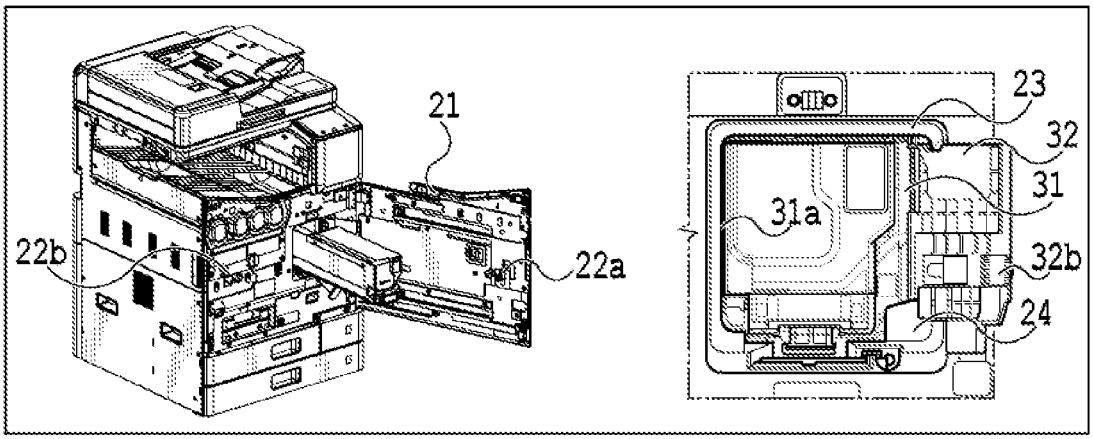

Then, the draw work of the print head 8 is performed by a user through the opening 31*a* of the head holder 31. FIG. 13C is an explanatory diagram of the entire printing apparatus and the periphery of the opening on the front side of the printing apparatus in the state where the print head 8 is drawn from the casing 4 by the print head exchange work. As shown in the left diagram and the right diagram in FIG. 13C, the print head 8 is drawn to the front side on the front side of the casing 4 through the opening 23 of the casing 4. By the print head 8 being drawn, the connection of the print head 8 with the power source connector 36 of the head holder 31 is cancelled.

Consequently, the old print head 8 mounted on the head holder 31 (casing 4) is detached.

Then, the attachment work of the new print head 8 is performed by a user under a procedure opposite to the procedure of the detachment work of the old print head 8 mounted on the head holder 31 (casing 4). First, the new print head 8 is pushed into the head holder 31 by a user or the like through the opening 23 from the front side of the casing 4 and mounted within the head holder 31 (casing 4). Due to this, the power source connector, not shown schematically, of the new print head 8 is connected with the power source connector 36 of the head holder 31. Next, the moving work of the head signal cable 33, the connecting work with the print head 8 side, and the closing work of the head holder door 32 are performed by a user or the like and by the operation of the slide lever 32*c*, the head holder door 32 enters the lock state.

At S1109, the work to exchange only the print head 8 is explained, but it is also possible to simultaneously perform the exchange work of the ink tank unit 14 and the maintenance cartridge 16*b*. Because the front door 21 is in the open state, it is possible for a user to directly access the portion at which the ink tank unit 14 and the maintenance cartridge 16*b* are arranged from the front side of the casing 4. Because of this, the work to exchange the old ink tank unit 14 and the old maintenance cartridge 16*b* attached to the casing 4 with the new ink tank unit 14 and the new maintenance cartridge 16*b* is easy for a user or the like.

At S1110, a user or the like closes the front door 21. By this work, a state is brought about where the interlock mechanism 25 and the protrusion 26 engage with each other, and therefore, power is supplied to the holder moving device and the cap unit 10.

At S1111, the maintenance control unit 210 brings, in a case of detecting the closure of the front door 21, the front door 21 into the lock state where the door latch 22*a* and the door hook 22*b* engage with each other. Due to this, the front door 21 is fixed in the state where the front door 21 covers the entire range from the lower portion of the discharging tray 13 to the upper portion of the first cassette 5A on the front side of the casing 4.

At S1112, the maintenance control unit 210 determines whether or not the ink tank unit 14 is attached. In a case where the maintenance control unit 210 detects the attachment of the ink tank unit 14 and determines that the ink tank unit 14 is attached, the processing advances to S1113. In a case where the maintenance control unit 210 does not detect the attachment of the ink tank unit 14 and determines that the ink tank unit 14 is not attached, the processing returns to S1107 and the processing at S1107 to S1111 is performed again.

At S1113, the maintenance control unit 210 determines whether or not the maintenance cartridge 16*b* is attached. In a case where the maintenance control unit 210 detects the attachment of the maintenance cartridge 16*b* and determines that the maintenance cartridge 16*b* is attached, the processing advances to S1114. In a case where the maintenance control unit 210 does not detect the attachment of the maintenance cartridge 16*b* and determines that the maintenance cartridge 16*b* is not attached, the processing returns to S1107 and the processing at S1107 to S1112 is performed again.

At S1114, the maintenance control unit 210 determines whether or not the head holder door 32 is closed. In a case where the maintenance control unit 210 detects the closure of the head holder door 32 and determines that the head holder door 32 is closed, the processing advances to S1115. In a case where the maintenance control unit 210 does not detect the closure of the head holder door 32 and determines that the head holder door 32 is not closed, the processing returns to S1107 and the processing at S1107 to S1113 is performed again.

At S1115, the maintenance control unit 210 determines whether or not the power source connector 36 of the head holder 31 is connected with the power source connector, not shown schematically, of the print head 8. In a case where the maintenance control unit 210 detects the connection of the power source connector and determines that the power source connector is connected between the print head 8 and the head holder 31, the processing advances to S1116. In a case where the maintenance control unit 210 does not detect the connection of the power source connector and determines that the power source connector is not connected between the print head and the head holder, the processing returns to S1107 and the processing at S1107 to S1114 is performed again.

At S1116, the maintenance control unit 210 determines whether or not the head signal cable 33 is connected with the print head 8 side. In a case where the maintenance control unit 210 detects the connection of the head signal cable 33 and determines that that head signal cable 33 is connected, the processing advances to S1117. In a case where the maintenance control unit 210 does not detect the connection of the head signal cable 33 and determines that the head signal cable 33 is not connected, the processing returns to S1107 and the processing at S1107 to S1115 is performed again.

At S1117, the maintenance control unit 210 causes the joint drive unit 38 to go into action and to connect the ink supply joint unit 35 to the print head 8. Due to this, the ink supply tube 34 connects with the print head 8 side.

At S1118, the maintenance control unit 210 moves, in a case of detecting the connection of the ink supply joint unit 35, the print head 8 to the cap closed position.

At S1119, the maintenance control unit 210 closes the cap by causing the cap member 10*a* to come into contact with the ejection opening surface 8*a* of the print head 8.

At S1120, the maintenance control unit 210 fills the print head 8 with ink by the ink supply unit 15.

At S1121, in a case of detecting the completion of the processing to fill the print head 8 with ink, the maintenance control unit 210 performs the cleaning processing for the ejection opening surface 8*a* of the print head 8 by the maintenance unit 16.

By the processing at S1101 to S1121 being performed, it is possible to exchange the old print head 8 mounted on the head holder 31 of the casing 4 with the new print head 8.

After the processing at S1121, the connecting processing of the ink supply joint to the print head 8 and the movement of the print head 8 to the cap closed position are performed in accordance with the necessity.

In a case where instructions to exchange the print head 8 are received, after the operation to satisfy the open condition of the front door 21 is performed, the lock state of the front door 21 is cancelled. Then, by a user opening the front door 21, it is made possible to access the print head 8, the ink tank unit 14, the maintenance cartridge 16*b*, and so on. As described above, after the predetermined condition is satisfied and the predetermined operation is performed, it is made possible for the first time for a user or the like to access the print head 8, the ink tank unit 14, the maintenance cartridge 16*b*, and so on. Because of this, it is possible to prevent in advance the exchange work of the print head 8 and the like under an erroneous procedure by a user or the like. Not only the portion at which the print head 8 is arranged but also the entire range including the portion at which the ink tank unit 14 and the maintenance cartridge 16*b* are arranged is covered by the one front door 21. Because of this, it is not necessary to install a cover for each of the print head 8, the ink tank unit 14, and the maintenance cartridge 16*b*, and therefore, it is possible to suppress the cost accordingly.

In a case where the front door 21 is located at a position opened from the closed position, the engagement between the interlock mechanism 25 and the protrusion 26 is cancelled and supply of power to the holder moving device and the cap unit 10 is shut off. Due to this, a state is brought about where the function of moving operation of the head holder 31 by the holder moving device and the function of suction operation of ink by the cap unit 10 are disabled, and therefore, the front side of the casing 4, which is covered by the front door 21, enters an environment in which it is easy for a user or the like to work.

<About Ink Tank Unit and Maintenance Cartridge Exchange>

Next, details of the processing at the time of exchanging the ink tank unit and the maintenance cartridge in the present embodiment are explained.

Figure 14:
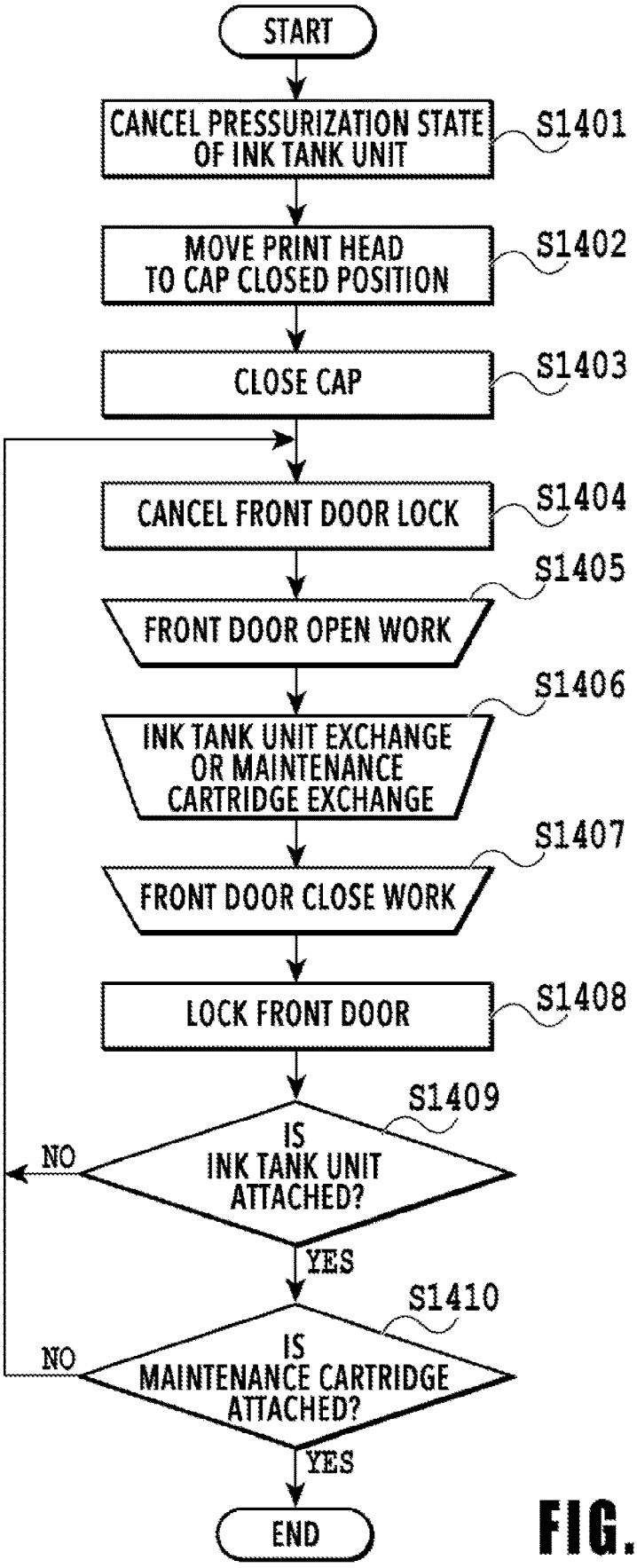
FIG. 14 is a flowchart at the time of ink tank unit and maintenance cartridge exchange.

FIG. 14 is a flowchart at the time of the ink tank unit and maintenance cartridge exchange work accompanied by the front door open work. The sequence at the time of the ink tank unit and maintenance cartridge exchange work shown in FIG. 14 is performed by the maintenance control unit 210 based on instructions from a user. Here, explanation of the steps at which the same processing as that in the flowchart at the time of the print head exchange work described above is performed is simplified or omitted and steps different from those in the flowchart at the time of the print head exchange work are explained in detail.

Figure 15A:
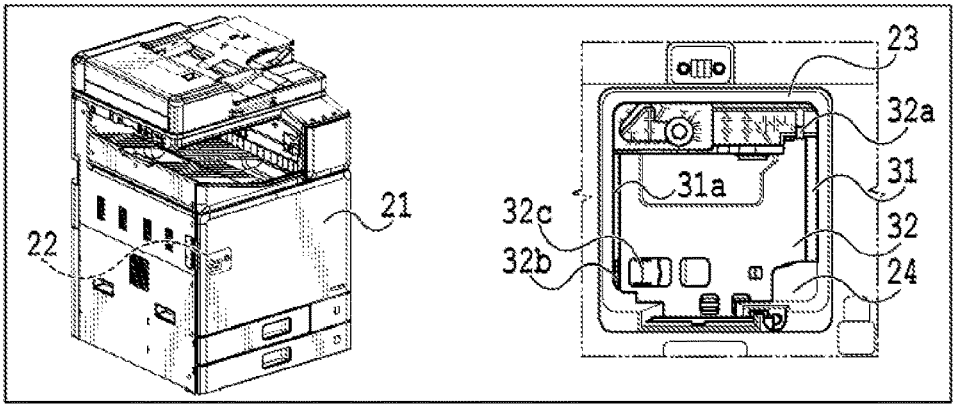
FIG. 15A to FIG. 15D are explanatory diagrams until a state where the front door is opened.

At S1401, the maintenance control unit 210 causes, as in the case with S1101, the ink supply control unit 209 to perform the pressure relief processing of the ink tank unit 14. FIG. 15A is, as in the case with FIG. 12A, an explanatory diagram of the entire printing apparatus and the periphery of the opening on the front side of the printing apparatus in the state where the pressurization of the ink tank unit 14 is cancelled. As shown in the left diagram in FIG. 15A, the front door 21 is in the lock state and fixed in the state where the front door 21 covers the entire range from the lower portion of the discharging tray to the upper portion of the first cassette 5A on the front side of the casing 4. As shown in the right diagram in FIG. 15A, on the periphery of the opening on the front side of the casing 4 covered by the front door 21, the head holder 31 (print head 8) does not coincide in height with the opening 23 in the height direction and is held in the state where part of the head holder 31 overlaps the lower portion of the opening 23.

Figure 15B:
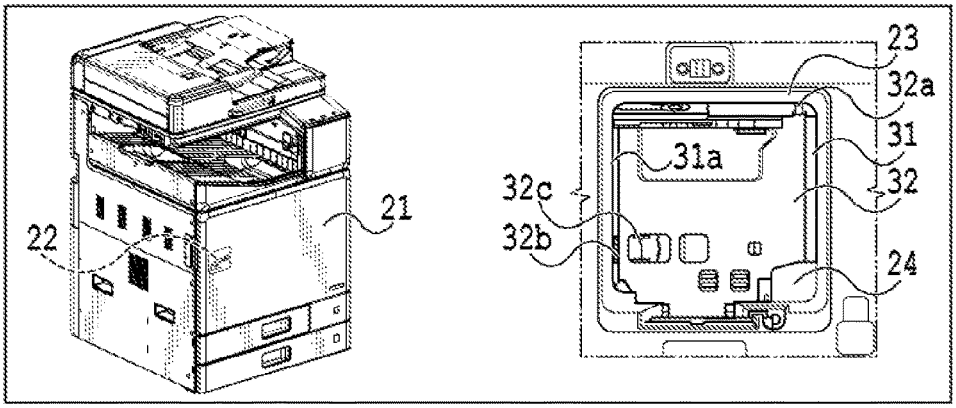

At S1402, the maintenance control unit 210 moves, as in the case with S1102, in a case where the pressurization state of the ink tank unit 14 is cancelled by the pressure relief processing of the ink tank unit 14, the print head 8 is moved to the cap closed position. FIG. 15B is, as in the case with FIG. 12B, an explanatory diagram of the entire printing apparatus and the periphery of the opening on the front side of the printing apparatus in the state where the print head is moved to the cap closed position. As shown in the right diagram in FIG. 15B, on the front side of the casing 4 covered by the front door 21, the head holder 31 (print head 8) is held in the state where part of the head holder 31 overlaps the lower portion of the opening 23 in the height direction. That is, the head holder 31 (print head 8) is arranged at a position that is not the first position in the state where the print head 8 is detachable. That is, the head holder 31 is arranged at the second position in the state where the print head 8 is undetachable. The door hook 22*b* of the lock mechanism 22 of the front door 21 is maintained in the lock state where the door hook 22*b* engages with the door latch 22*a* as shown in the left diagram in FIG. 15B.

At S1403, the maintenance control unit 210 closes the cap by causing the cap member 10*a* to come into contact with the ejection opening surface 8*a* of the print head 8.

By the processing at S1401 to S1403 being performed, the open condition of the front door 21 at the time of the ink tank unit and maintenance cartridge exchange work is satisfied. That is, the access condition of a user or the like for the portion covered by the front door 21 is satisfied and a state is brought about where it is possible for a user or the like to perform the exchange work of the ink tank unit 14 and the maintenance cartridge 16*b*.

Figure 15C:
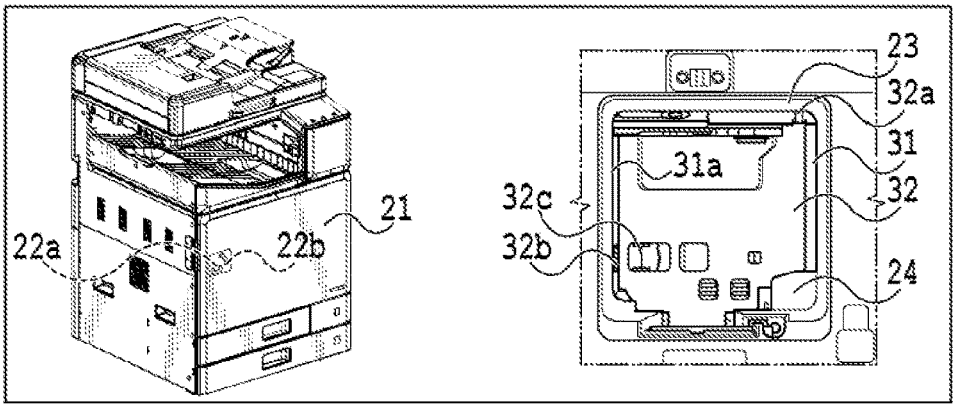

At S1404, the maintenance control unit 210 cancels, as in the case with S1107, the lock state of the front door 21. FIG. 15C is an explanatory diagram of the entire printing apparatus and the periphery of the opening on the front side of the printing apparatus in the state where the front door is unlocked. As shown in the left diagram in FIG. 15C, the door hook 22*b* of the lock mechanism 22 of the front door 21 is in the state where the engagement with the door latch 22*a* is cancelled and the front door 21 is held in the state where the front door 21 is openable and closable for the front side of the casing 4. On the front side of the casing 4 covered by the front door 21, as shown in the right diagram in FIG. 15C, the print head 8 is held in the state where the print head 8 is positioned at S1402 in the height direction.

Figure 15D:
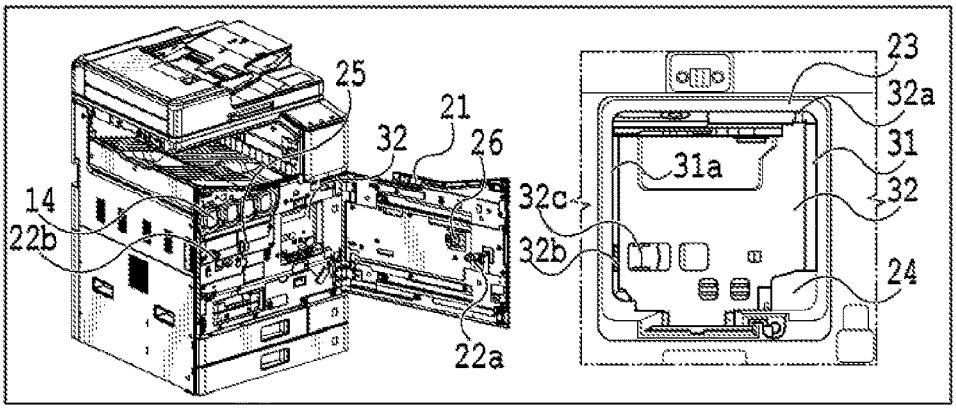

At S1405, a user or the like opens the front door 21 as in the case with S1108. FIG. 15D is an explanatory diagram of the entire printing apparatus and the periphery of the opening on the front side of the printing apparatus in the state where the front door is opened. As shown in the left diagram in FIG. 15D, a state is brought about where the front door 21 is opened. By this work, a state is brought about where the engagement between the interlock mechanism 25 and the protrusion 26 is cancelled is brought about, and therefore, supply of power to the holder moving apparatus and the cap unit 10 is shut off. On the front side of the casing 4 covered by the front door 21, as shown in the right diagram in FIG. 15D, the head holder 31 (print head 8) is held in the state where the print head 8 is positioned at S1402 in the height direction.

Figure 16:
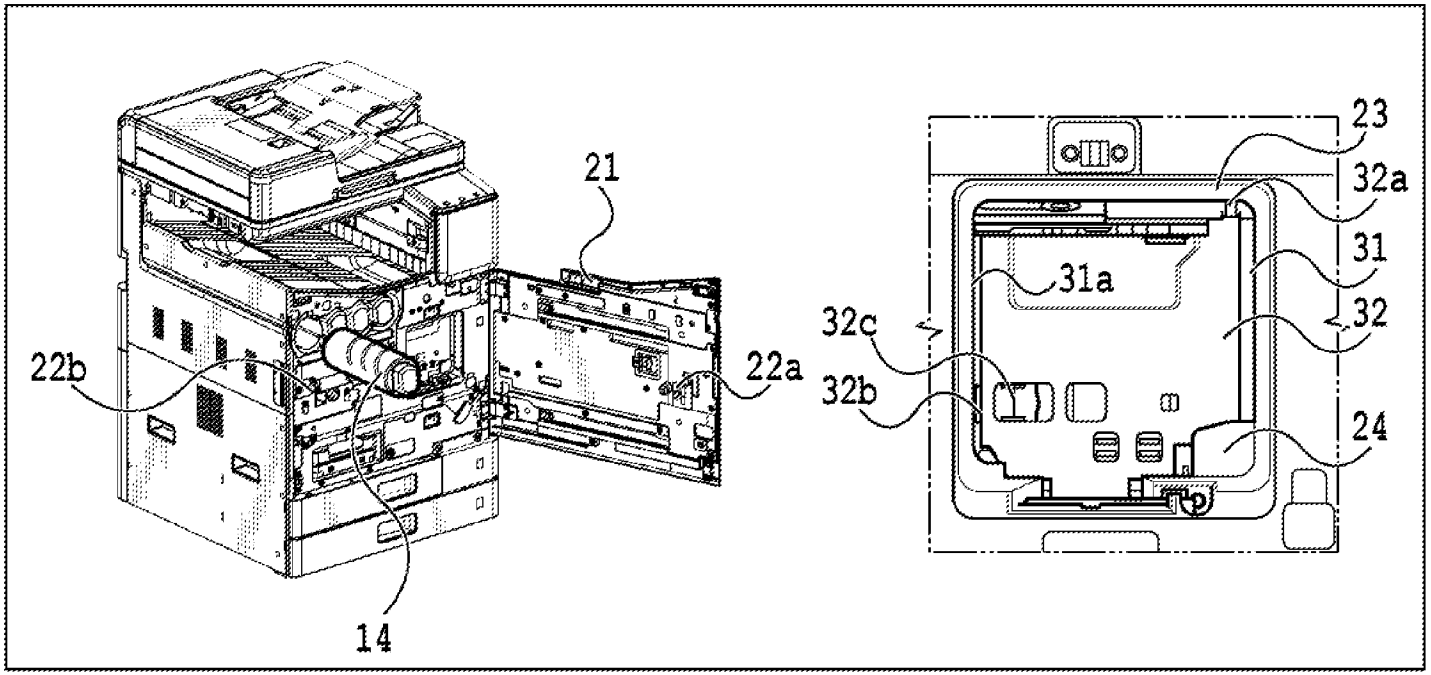
FIG. 16 is a diagram of a state where the ink tank unit is drawn.

At S1406, the exchange work of the ink tank unit 14 and the maintenance cartridge 16*b* is performed by a user or the like. The ink tank unit 14 is drawn from the casing 4 by a user. FIG. 16 is an explanatory diagram of the entire printing apparatus and the periphery of the opening on the front side of the printing apparatus in the state where the ink tank unit 14 is drawn from the casing 4 by the ink tank unit exchange work. As shown in the left diagram and the right diagram in FIG. 16, the ink tank unit 14 is drawn to the front side on the front side of the casing 4. At this time, the connection between the ink tank unit 14 and the casing 4 is cancelled.

Then, the attachment work of the new ink tank unit 14 by a user is performed under a procedure opposite to the procedure of the detachment work of the old ink tank unit 14. By a user or the like, the new ink tank unit 14 is pushed into the portion at which the old ink tank unit 14 was attached from the front side of the casing 4. Due to this, the connection between the new ink tank unit 14 and the casing 4 is performed. At S1406, the work to exchange only the ink tank unit 14 is explained, but it is also possible to perform the exchange work of the maintenance cartridge 16*b* in place of the ink tank unit 14. Further, it is also possible to simultaneously perform the exchange work of the maintenance cartridge 16*b*. In a case where the maintenance cartridge 16*b* is exchanged, the front door 21 is in the open state, and therefore, it is possible for a user to access the portion at which the maintenance cartridge 16*b* is attached directly from the front side of the casing 4. Because of this, the work to exchange the old maintenance cartridge 16*b* attached to the casing 4 with the new maintenance cartridge 16*b* is easy for a user.

At S1407, a user or the like closes the front door 21 as in the case with S1110. By this work, a state is brought about where the interlock mechanism 25 and the protrusion 26 engage with each other, and therefore, power is supplied to the holder moving device and the cap unit 10.

At S1408, the maintenance control unit 210 brings, as in the case with S1111, in a case of detecting the closure of the front door 21, the front door 21 into the lock state where the door latch 22*a* and the door hook 22*b* engage with each other. Due to this, the front door 21 is fixed in the state where the front door 21 covers the entire range from the lower portion of the discharging tray 13 to the upper portion of the first cassette 5A on the front side of the casing 4.

At S1409, the maintenance control unit 210 determines whether or not the ink tank unit 14 is attached. In a case where the maintenance control unit 210 detects the attachment of the ink tank unit 14 and determines that the ink tank unit 14 is attached, the processing advances to S1410. In a case where the maintenance control unit 210 does not detect the attachment of the ink tank unit 14 and determines that the ink tank unit 14 is not attached, the processing returns to S1404 and the processing at S1404 to S1408 is performed again.

At S1410, the maintenance control unit 210 determines whether or not the maintenance cartridge 16*b* is attached. In a case where the maintenance control unit 210 detects the attachment of the maintenance cartridge 16*b* and determines that the maintenance cartridge 16*b* is attached, this processing is exited. In a case where the maintenance control unit 210 does not detect the attachment of the maintenance cartridge 16*b* and determines that the maintenance cartridge 16*b* is not attached, the processing returns to S1404 and the processing at S1404 to S1409 is performed again.

In a case where instructions to exchange the ink tank unit 14 or the maintenance cartridge 16*b* are received, after the operation to satisfy the open condition of the front door 21 is performed, the lock state of the front door 21 is cancelled. Then, by a user opening the front door 21, it is made possible for a user or the like to access the ink tank unit 14, the maintenance cartridge 16*b*, and so on. As described above, after the predetermined condition is satisfied and the predetermined operation is performed, it is made possible for the first time for a user or the like to access the ink tank unit 14, the maintenance cartridge 16*b*, and so on. Because of this, it is possible to prevent in advance the exchange work of the ink tank unit 14, the maintenance cartridge 16*b*, and so on under an erroneous procedure by a user or the like. Not only the portion at which the ink tank unit 14 and the maintenance cartridge 16*b* are arranged but also the entire range including the portion at which the print head 8 is arranged is covered by the one front door 21. Because of this, it is not necessary to install a cover for each of the print head 8, the ink tank unit 14, and the maintenance cartridge 16*b*, and therefore, it is possible to suppress the cost accordingly. Further, at the time of exchange of the ink tank unit 14 and the maintenance cartridge 16*b*, by bringing about a state where it is not possible to open the front door 21 of the print head 8 physically, a user is suppressed from erroneously accessing the print head 8.

Furthermore, at the time of exchange of the ink tank unit 14 or the maintenance cartridge 16*b*, the number of operations necessary for cancelling the lock mechanism 22 is small compared to that at the time of exchange of the print head 8. Because of this, it is possible to cancel the lock mechanism 22 more quickly than in a case where the print head 8 is exchanged, and therefore, it is possible to reduce the time necessary for exchange.

In a case where the front door 21 is in an open state opened from the closed position, the engagement between the interlock mechanism 25 and the protrusion 26 is cancelled and supply of power to the holder moving device and the cap unit 10 is shut off. Due to this, a state is brought about where the function of moving operation of the head holder 31 by the holder moving device and the function of suction operation of ink by the cap unit 10 are disabled, and therefore, the front side of the casing 4, which is covered by the front door 21, enters an environment in which it is easy for a user or the like to work.

The maintenance control unit 210 controls the holder moving device, the ink supply unit 15, and the lock mechanism 22 in accordance with operation instructions input to the operating panel 104, and therefore, it is possible to securely cause each device to perform operation in accordance with operation instructions from a user.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present embodiment, it is possible to easily perform an exchange work while preventing in advance an exchange work of an exchange-target device under an erroneous procedure by a user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-045674, filed Mar. 13, 2018, which is hereby incorporated by reference herein in its entirety.

What is claimed is:

1. A printing apparatus comprising:

a head holder that mounts a print head detachably, the head holder being movable to a first position at which the print head is detachable and to a second position at which the print head is undetachable;

an ink tank, detachable from the apparatus, the ink tank being configured to store ink to be supplied to the print head;

an ink supply unit configured to pressurize and supply ink from the ink tank to the print head;

a cover that covers the head holder and the ink tank;

a lock mechanism capable of switching between a lock state where the cover is fixed to a closed position and an unlocked state where the cover is not fixed to the closed position; and a central processing unit configured to control, in a case of receiving instructions to detach the ink tank, the lock mechanism to switch to the unlocked state after controlling movement of the head holder to the second position, as well as controlling the ink supply unit to stop pressurization.

2. The printing apparatus according to claim 1, wherein the central processing unit controls, in a case of receiving instructions to detach the print head, the lock mechanism to switch to the unlocked state after controlling the movement of the head holder to the first position, as well as controlling the ink supply unit to stop pressurization.

3. The printing apparatus according to claim 1, further comprising:

a cap configured to cover an ink ejection portion provided in the print head, wherein the printing apparatus is configured such that the head holder is moved to a cap closed position, as the second position, at which the ink ejection portion and the cap come into contact with each other.

4. The printing apparatus according to claim 1, wherein the central processing unit controls the lock mechanism to bring the cover into the lock state in a case where the instructions are not received.

5. The printing apparatus according to claim 1, further comprising:

a head holder door configured to be openable in a case of receiving instructions to detach the print head, wherein, in a case where the head holder is arranged at a position other than the first position, the head holder door is regulated from changing into an open state.

6. The printing apparatus according to claim 1, further comprising:

an operating mechanism to which the instructions are input, wherein the central processing unit controls the ink supply unit and the lock mechanism in accordance with instructions input by the operating mechanism.

7. A printing apparatus comprising:

a head holder that mounts a print head detachably, the head holder being movable to a first position at which the print head is detachable and to a second position at which the print head is undetachable, and the print head having an ink ejection portion that ejects ink;

an ink supply unit configured to pressurize and supply ink from an ink tank to the print head;

a cap configured to cover the ink ejection portion;

a waste ink cartridge detachable from the apparatus and connected to the cap;

a cover that covers the head holder and the waste ink cartridge;

a lock mechanism capable of switching between a lock state where the cover is fixed to a closed position and an unlocked state where the cover is not fixed to the closed position; and a central processing unit configured to control, in a case of receiving instructions to detach the waste ink cartridge, the lock mechanism to switch to the unlocked state after controlling movement of the head holder to the second position, as well as controlling the ink supply unit to stop pressurization.

8. The printing apparatus according to claim 7, wherein the printing apparatus is configured such that the head holder is moved to a cap closed position, as the second position, at which the ink ejection portion and the cap come into contact with each other.

9. The printing apparatus according to claim 7, wherein the ink tank is covered by the cover at the closed position and detachable from the apparatus.

10. A control method of a printing apparatus including (a) a head holder that mounts a print head detachably, the head holder being movable to a first position at which the print head is detachable and to a second position at which the print head is undetachable, (b) an ink tank, detachable from the apparatus, the ink tank being configured to store ink to be supplied to the print head, (c) an ink supply unit configured to pressurize and supply ink from the ink tank to the print head, (d) a cover that covers the head holder and the ink tank, and (e) a lock mechanism capable of switching between a lock state where the cover is fixed to a closed position and an unlocked state where the cover is not fixed to the closed position, the control method comprising:

a moving step of controlling movement of the head holder to the second position;

a stop step of controlling the ink supply unit to stop pressurization; and a first switch step of controlling, in a case of receiving instructions to detach the ink tank, the lock mechanism to switch to the unlocked state after the moving step and the stop step.

11. The control method according to claim 10, further comprising a second switch step of controlling, in a case of receiving instructions to detach the print head, the lock mechanism to switch to the unlocked state after the moving step and the stop step.

12. The control method according to claim 10, wherein the printing apparatus includes a cap configured to cover an ink ejection portion provided in the print head, and wherein the head holder is moved to a cap closed position, as the second position, at which the ink ejection portion and the cap come into contact with each other.

* * * * *